US010156208B2

(12) United States Patent
Kishi et al.

(10) Patent No.: US 10,156,208 B2
(45) Date of Patent: Dec. 18, 2018

(54) INSPECTION APPARATUS AND INSPECTION METHOD

(71) Applicant: DENSO CORPORATION, Kariya, Aichi-pref. (JP)

(72) Inventors: Ryoyuu Kishi, Kariya (JP); Yasuo Kato, Kariya (JP); Shigeru Hasegawa, Kariya (JP); Tomohiro Itoh, Kariya (JP); Makoto Kaneko, Kariya (JP); Kosei Takagi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/738,241

(22) PCT Filed: Jun. 16, 2016

(86) PCT No.: PCT/JP2016/067864
§ 371 (c)(1),
(2) Date: Dec. 20, 2017

(87) PCT Pub. No.: WO2016/208475
PCT Pub. Date: Dec. 29, 2016

(65) Prior Publication Data

US 2018/0187632 A1 Jul. 5, 2018

(30) Foreign Application Priority Data

Jun. 22, 2015 (JP) ..... 2015-124921
Jun. 3, 2016 (JP) ..... 2016-111892

(51) Int. Cl.
*F02M 25/08* (2006.01)

(52) U.S. Cl.
CPC ..... *F02M 25/0809* (2013.01); *F02M 25/08* (2013.01); *F02M 25/0872* (2013.01); *F02M 2025/0845* (2013.01)

(58) Field of Classification Search
CPC ..... F02M 25/08; F02M 25/0809; F02M 25/0872; F02M 2025/0845
See application file for complete search history.

(56) References Cited

U.S. PATENT DOCUMENTS 8,630,786 B2 * 1/2014 Jackson ..... F02D 41/0037 123/521
9,297,340 B2 * 3/2016 Pearce ..... F02M 25/0809
(Continued)

FOREIGN PATENT DOCUMENTS

JP 2014-152678 6/2014
JP 2014-101776 8/2014

*Primary Examiner* — Hieu T Vo
(74) *Attorney, Agent, or Firm* — Nixon & Vanderhye P.C.

(57) ABSTRACT

An inspection apparatus includes a pressure sensor, a reference orifice, a pump, and a switching valve. The reference orifice is disposed in a first communication passage communicating a pressure passage receiving the pressure sensor, with a tank passage communicating with a fuel tank. The pump depressurizing or pressurizing the pressure passage includes an intake port and a discharge port, and one of which communicates with an atmospheric passage communicating with the atmosphere and the other one communicates with the pressure passage. The switching valve and switches between a state shutting off a communication of a second communication passage that leads to the pressure passage and passages other than the pressure passage and communicating the atmospheric passage with the tank passage and a state shutting off a communication of the atmospheric passage and passages other than the pump and the atmosphere and communicating the second communication passage with the tank passage.

12 Claims, 19 Drawing Sheets

(56) References Cited

U.S. PATENT DOCUMENTS

| | | | |
|---|---|---|---|
| 2006/0150722 | A1 | 7/2006 | Kato et al. |
| 2007/0214871 | A1 | 9/2007 | Kato |

* cited by examiner

INSPECTION APPARATUS AND INSPECTION METHOD

CROSS REFERENCE TO RELATED APPLICATION

This application is the U.S. national phase of International Application No. PCT/JP2016/067864 filed Jun. 16, 2016 which designated the U.S. and claims priority to Japanese Patent Application No. 2015-124921 filed on Jun. 22, 2015 and Japanese Patent Application No. 2016-111892 filed on Jun. 3, 2016, the entire contents of each of which are incorporated herein by reference.

TECHNICAL FIELD

The present disclosure relates to an inspection apparatus and an inspection method which inspect a leakage of an evaporated fuel.

BACKGROUND ART

Up to now, an inspection apparatus that inspects leakage of an evaporated fuel generated in a fuel tank and leakage of an evaporated fuel from a canister that recovers the evaporated fuel generated in the fuel tank has been known.

The inspection apparatus disclosed in Patent Literature 1 inspects the leakage of the evaporated fuel by the following method. In the method, first, when an internal combustion engine is stopped, a pump is operated in a state in which a flow channel that leads to the atmosphere, a flow channel that leads to a reference orifice, and a flow channel that leads to the pump are communicated in the stated order, and a pressure of the flow channel that leads to the reference orifice is detected as a reference pressure. Next, an electromagnetic valve is driven so as to be switched to shut off the flow channel that leads to the atmosphere, and communicate the flow channel that leads to the pump with the flow channel that leads to the canister and the tank. Subsequently, the pump is operated to reduce a pressure in the fuel tank and the pressure in the flow channel leading to the canister and the tank is detected as a system pressure. Finally, the reference pressure is compared with the system pressure, to thereby determine whether an evaporated fuel leakage in the canister and the fuel tank falls within an allowable range, or not.

PRIOR ART LITERATURES

Patent Literature

Patent Literature 1: JP2014-152678A

SUMMARY OF INVENTION

The inspection apparatus disclosed in Patent Literature 1 is configured to switch between a communication and shut-off of the flow channel that leads to the atmosphere, the flow channel that leads to the reference orifice, the flow channel that leads to the pump, and the flow channel that leads to the canister and the tank with the use of the electromagnetic valve. A drive unit of the electromagnetic valve includes a coil, a stator, a mover, and the like. For that reason, the drive unit of the electromagnetic valve increases a size of the inspection apparatus. Further, there is a possibility that an electric power consumed by the inspection apparatus increases due to the driving of the electromagnetic valve.

An object of the present disclosure is to provide an inspection apparatus and an inspection method capable of reducing a body size and reducing a power consumption.

According to a first aspect of the present disclosure, the inspection apparatus includes a pressure sensor, a reference orifice, a pump, and a switching valve. The reference orifice is disposed in a first communication passage that communicates a pressure passage provided with the pressure sensor, with a tank passage communicating with a fuel tank. The pump configured to depressurize or pressurize the pressure passage includes an intake port and a discharge port, and one of the intake port and the discharge port communicates with an atmospheric passage that communicates with the atmosphere and the other one of the intake port and the discharge port communicates with the pressure passage. The switching valve is configured to operate according to a differential pressure between the pressure passage and the atmospheric passage, which changes depending on the driving of the pump, and to switch between a state to shut off a communication of a second communication passage that leads to the pressure passage and passages other than the pressure passage and to communicate the atmospheric passage with the tank passage and a state to shut off a communication of the atmospheric passage and passages other than the pump and the atmosphere and to communicate the second communication passage with the tank passage.

The inspection apparatus is provided with the switching valve that operates according to the differential pressure between the pressure passage and the atmospheric passage, thereby being capable of eliminating an electromagnetic valve provided in a conventional inspection apparatus. Therefore, the inspection apparatus can be simplified in a structure and reduced in a body size. Further, since the inspection apparatus does not use an electromagnetic valve, a power consumption can be reduced.

According to a second aspect of the present disclosure, the inspection method includes a storing, a reducing, a storing, and a determining. In the storing, a pressure detected by the pressure sensor when the pump is rotated at a low speed in a case where the switching valve shuts off the communication of the second communication passage and the passages other than the pressure passage and allows the communication of the atmospheric passage and the tank passage is stored as a first reference pressure. In the reducing, a pressure in the tank passage in a state where the switching valve shuts off the communication of the atmospheric passage and the passages other than the pump and the atmosphere and allows the communication of the second communication passage and the tank passage by switching the pump from a low speed rotation to a high speed rotation is reduced. In the storing, a pressure detected by the pressure sensor in the state in the reducing by rotating the pump at the low speed is stored as a system pressure. In the determining, the evaporated fuel leakage of the fuel tank is determined to be larger than a reference value when an absolute value of the system pressure is smaller than the absolute value of the first reference pressure or when an absolute value of a difference between the system pressure and the first reference pressure is smaller than a predetermined threshold while comparing the first reference pressure with the system pressure, and the evaporated fuel leakage of the fuel tank is determined to be smaller than the reference value when the absolute value of the system pressure is larger than the absolute value of the first reference value and the absolute value of the difference between the system pressure and the first reference pressure is larger than the predetermined threshold while comparing the first reference pressure with the system pressure. The absolute value is an absolute value of a relative pressure when the atmospheric pressure is assumed to be zero.

The inspection method of the evaporated fuel leakage can control the operation of the switching valve by changing the rotational speed of the pump. Further, the inspection method rotates the pump at a high speed to reduce the pressure in the fuel tank and the canister, thereby can complete the evaporated fuel leakage inspection in a short time. Therefore, the inspection method can reduce the electric power consumed for the evaporated fuel leakage inspection.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
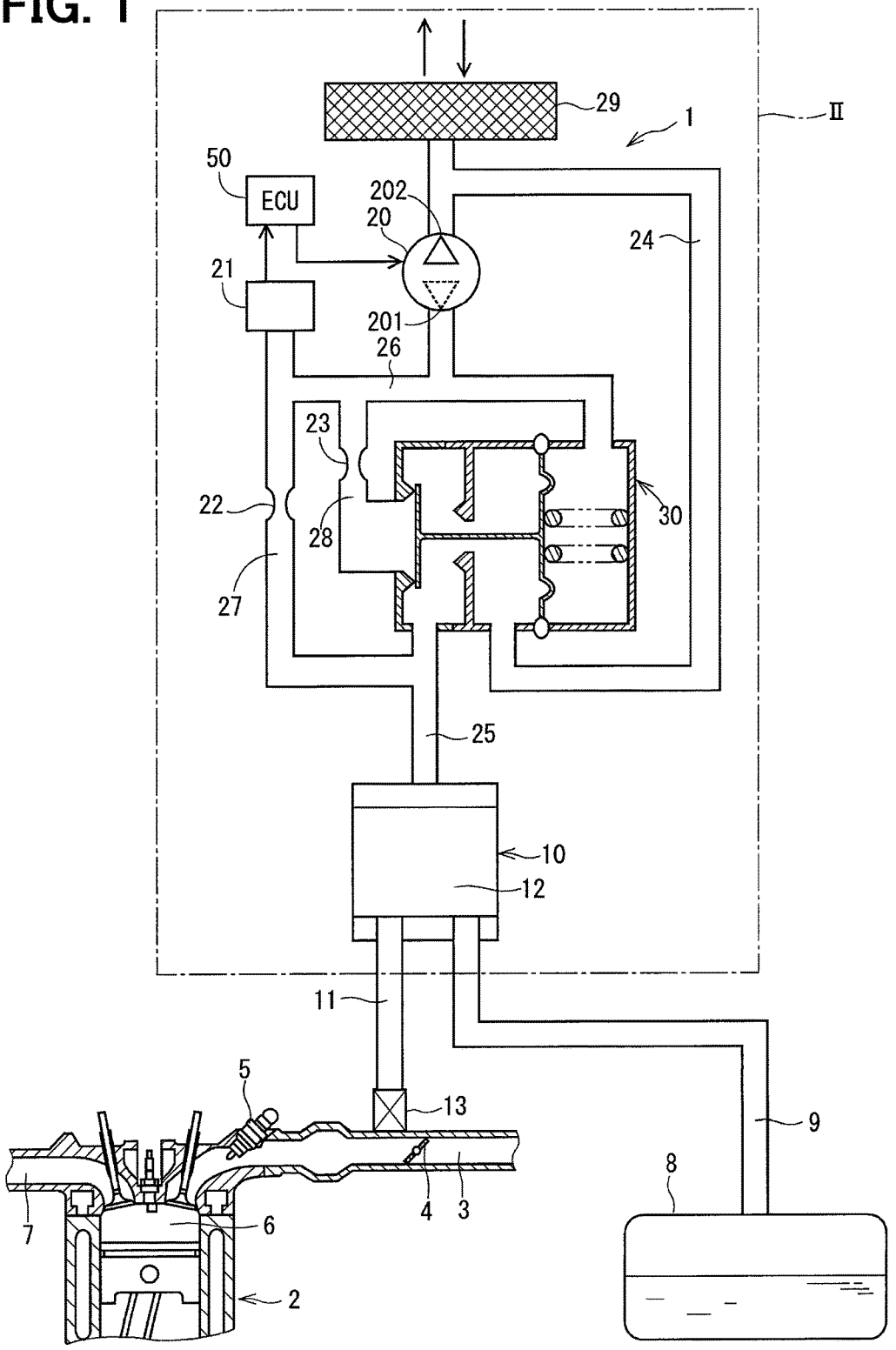
FIG. 1 is a schematic diagram showing an intake system of an engine to which an inspection apparatus according to a first embodiment of the present disclosure is applied.

Embodiments of the present disclosure will be described hereafter referring to drawings. In the embodiments, a part that substantially corresponds to a matter described in a preceding embodiment may be assigned with the same reference numeral, and redundant explanation for the part may be omitted.

First Embodiment

An inspection apparatus according to a first embodiment of the present disclosure is used for inspecting leakage of an evaporated fuel from a fuel tank and a canister.

FIG. 1 schematically shows an engine 2 to which an inspection apparatus 1 of the first embodiment is applied. A throttle valve 4 and an injector 5 are provided in an intake air passage 3 for introducing an air into the engine 2. A fuel injected from the injector 5 into the intake air passage 3 is introduced into a combustion chamber 6 of the engine 2 together with the air flowing through the intake air passage 3 and is combusted in the combustion chamber 6. The fuel is then discharged to the atmosphere through an exhaust passage 7.

An evaporated fuel is generated inside a fuel tank 8 in which the fuel to be supplied to the injector 5 is stored due to evaporation of the fuel. In order to process the evaporated fuel, the fuel tank 8 and the intake air passage 3 communicate with each other through a first purge passage 9, a canister 10, and a second purge passage 11. The evaporated fuel generated in the fuel tank 8 flows through the first purge passage 9 and is adsorbed and held by an adsorbent 12 such as activated carbon provided in the canister 10.

During the operation of the engine 2, when a purge valve 13 provided in the second purge passage 11 opens, the evaporated fuel adsorbed and held by the canister 10 is separated from the adsorbent 12 and removed into the intake air passage 3 through the second purge passage 11.

The inspection apparatus 1 inspects the evaporated fuel leakage from the fuel tank 8, the canister 10, the first purge passage 9, and the second purge passage 11 to an outside air.

Figure 2:
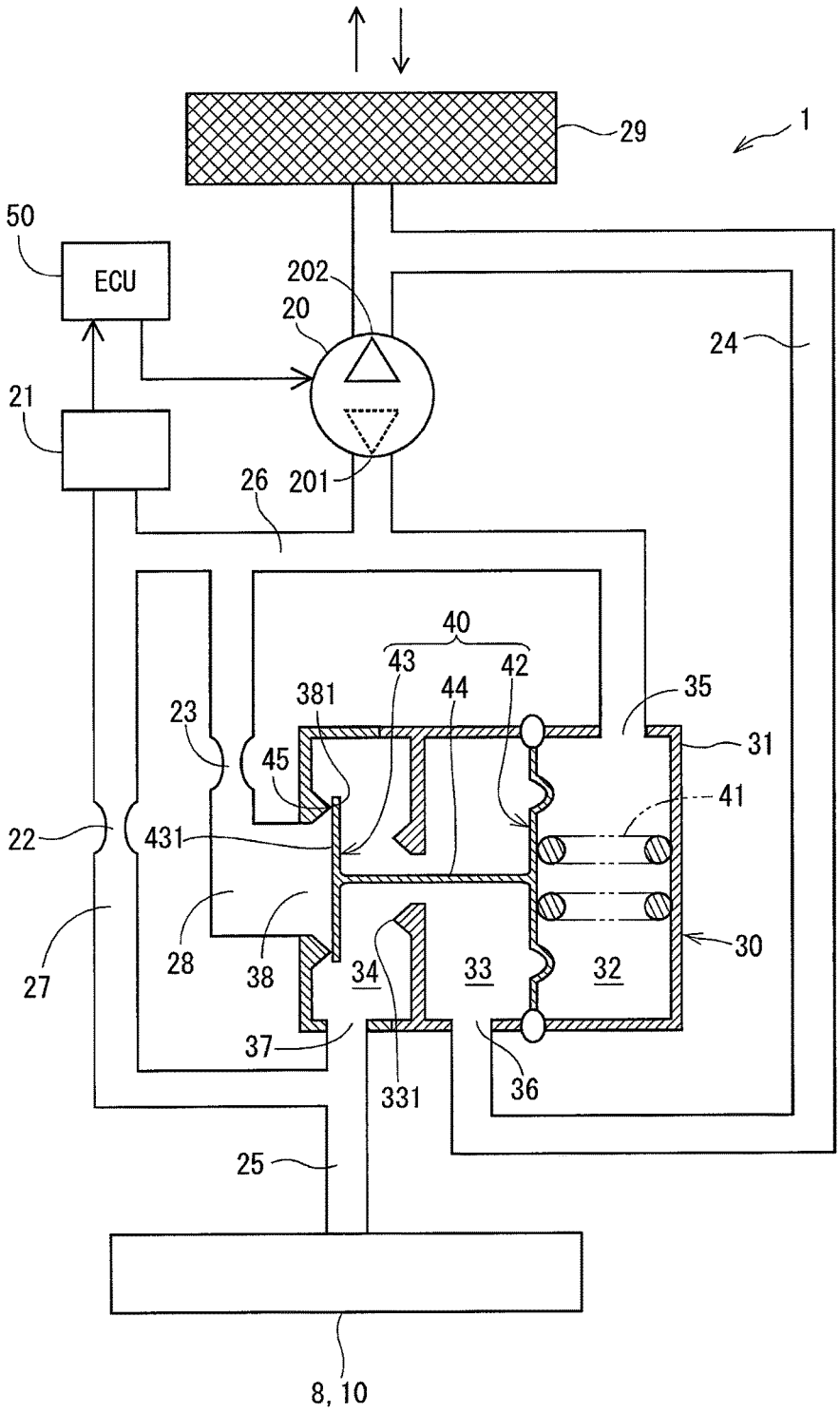
FIG. 2 is an enlarged view of a portion II in FIG. 1.

As shown in FIG. 2, the inspection apparatus 1 includes a pump 20, a pressure sensor 21, a switching valve 30, a reference orifice 22, a ventilation orifice 23, and the like. Further, the inspection apparatus 1 is formed with an atmospheric passage 24, a tank passage 25, a pressure passage 26, a first communication passage 27, a second communication passage 28 and the like.

The atmospheric passage 24 is open to the atmosphere through a filter 29. The atmospheric passage 24 communicates with an atmosphere port 36 of the switching valve 30.

The tank passage 25 communicates with the canister 10. The canister 10 communicates with the fuel tank 8 through the first purge passage 9 described above.

The pump 20 is, for example, a vane pump that sends an air from an intake port 201 to a discharge port 202 according to a rotational speed of an impeller not shown which is rotated by a motor not shown.

In the pump 20, the intake port 201 communicates with the pressure passage 26, and the discharge port 202 communicates with the atmospheric passage 24. The pump 20 is capable of reducing and increasing a pressure in the pressure passage 26. The pressure passage 26 communicates with the first communication passage 27, the second communication passage 28, and a pressure introduction port 35 of the switching valve 30.

When a rotational direction of the impeller is reversed, the pump 20 can also send the air from the discharge port 202 to the intake port 201. For that reason, the pump 20 can be installed with the discharge port 202 and the intake port 201 reversed in placement. In other words, the discharge port 202 and the intake port 201 are names for convenience.

The pressure sensor 21 provided in the pressure passage 26 detects an air pressure in the pressure passage 26 and transmits a signal from the pressure sensor 21 to an electronic control unit (ECU) 50 of a vehicle. The ECU 50 is a computer having a CPU, a RAM, a ROM, an input/output port, and the like. Based on a signal input from the pressure sensor 21, the ECU 50 detects the leakage of the evaporated fuel from the fuel tank 8 or the like. In addition, the ECU 50 controls an electric power to be supplied to a motor of the pump 20, thereby being capable of controlling the rotational speed of the impeller of the pump 20.

The first communication passage 27 communicates the pressure passage 26 with the tank passage 25 without passing through the switching valve 30. The reference orifice 22 is provided in the first communication passage 27. The reference orifice 22 is set to be smaller than a size of an opening in which the evaporated fuel leakage is permitted in the fuel tank 8. For example, according to the standards of the current CARB (California Air Resources Board and EPA (Environmental Protection Agency), detection of the evaporated fuel leakage from the opening equivalent to $\phi$0.5 mm is required. In the first embodiment, a cross-sectional area of the reference orifice 22 is set to, for example, $\phi$0.25 mm.

The second communication passage 28 communicates the pressure passage 26 with a ventilation port 38 of the switching valve 30. The ventilation orifice 23 is provided in the second communication passage 28. The ventilation orifice 23 may not be provided in the second communication passage 28.

The switching valve 30 is a differential pressure valve that operates according to a differential pressure between the pressure passage 26 and the atmospheric passage 24, which is changed by driving of the pump 20. The switching valve 30 has a housing 31, a valve member 40 and a spring 41.

The housing 31 is internally formed with a pressure chamber 32, an atmospheric pressure chamber 33, and a tank pressure chamber 34. In addition, the housing 31 is provided with the pressure introduction port 35 and the atmosphere port 36.

The pressure introduction port 35 communicates the pressure passage 26 with the pressure chamber 32. The atmosphere port 36 communicates the atmospheric passage 24 with the atmospheric pressure chamber 33. A tank port 37 communicates the tank passage 25 with the tank pressure chamber 34. The ventilation port 38 communicates the second communication passage 28 with the tank pressure chamber 34.

The housing 31 may be configured by a single member or multiple members, or a part of the housing 31 may be integrated with a member forming the atmospheric passage 24, the tank passage 25, the pressure passage 26, the second communication passage 28, and the like. In other words, in the first embodiment, the member forming the pressure chamber 32, the atmospheric pressure chamber 33, and the tank pressure chamber 34 is referred to as the housing 31.

The valve member 40 has a diaphragm 42 and a valve body 43.

The diaphragm 42 separates the pressure chamber 32 from the atmospheric pressure chamber 33 and operates upon receiving a differential pressure between the pressure chamber 32 and the atmospheric pressure chamber 33. The diaphragm 42 is urged toward the atmospheric pressure chamber 33 by the spring 41 provided in the pressure chamber 32.

The valve body 43 has a connecting portion 44 connected to the diaphragm 42 and operates together with the diaphragm 42. As shown in FIG. 2, a first seat surface 45 of the valve body 43 is capable of being seated on and separated from a first valve seat 381 provided in the ventilation port 38. Further, as shown in FIG. 3, a second seat surface 46 of the valve body 43 is capable of being seated on and separated from a second valve seat 331 provided between the tank pressure chamber 34 and the atmospheric pressure chamber 33.

The valve body 43 may be seated on the first valve seat 381 by an elastic force of the diaphragm 42 per se without the provision of the spring 41.

As shown in FIG. 2, when the valve body 43 is seated on the first valve seat 381, a communication of the second communication passage 28 with other than the pressure passage 26 is shut off, while the atmospheric passage 24 and the tank passage 25 communicate with each other. A position when the valve body 43 is seated on the first valve seat 381 is referred to as a first position.

Figure 3:
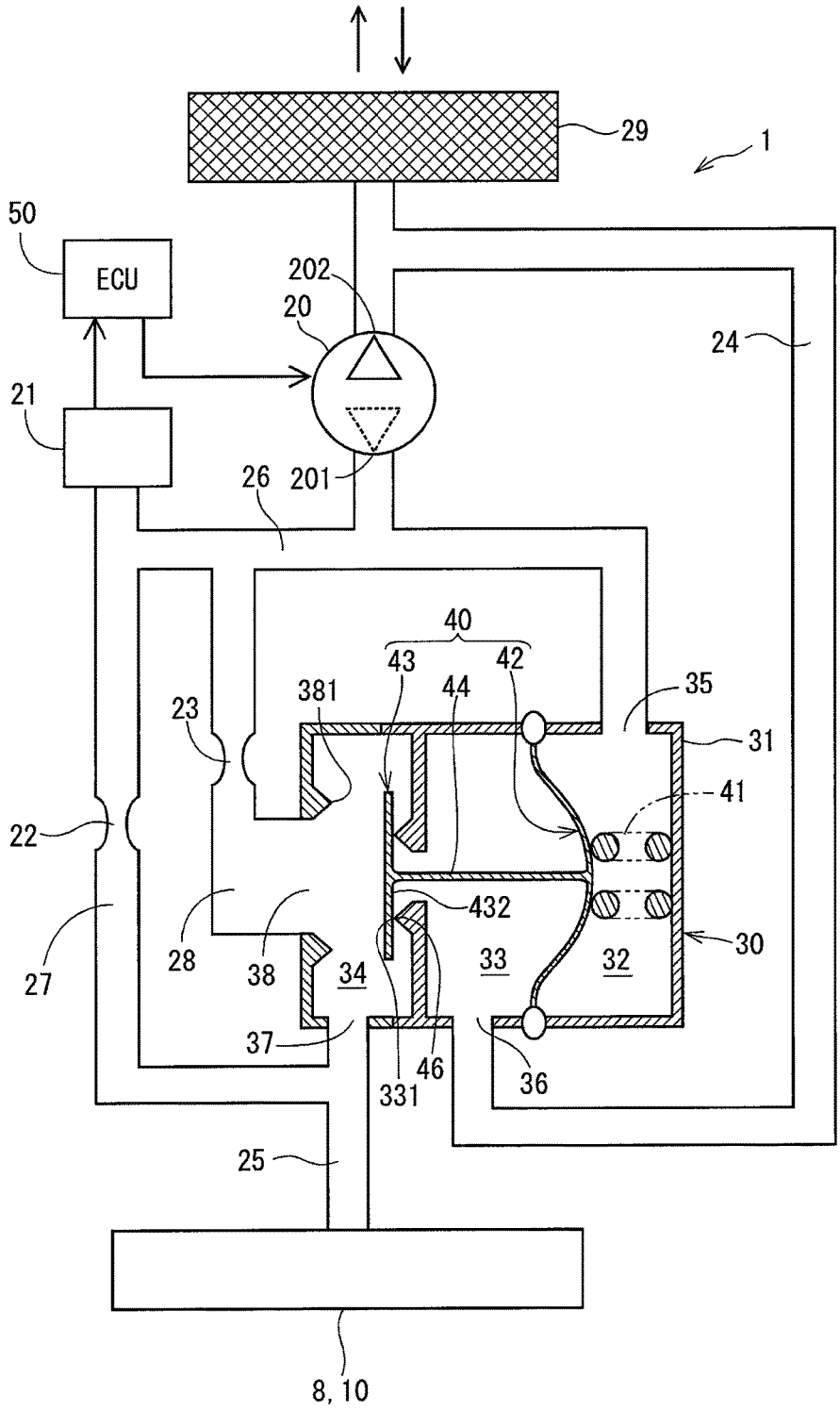
FIG. 3 is an enlarged view showing a state in which a switching valve is operated in a portion II in FIG. 1.

On the other hand, when the valve body 43 is seated on the second valve seat 331, as shown in FIG. 3, a communication of the atmospheric passage 24 with other than the pump 20 and the atmosphere is shut off while the second communication passage 28 and the tank passage 25 communicate with each other. A position when the valve body 43 is seated on the second valve seat 331 is referred to as a second position.

The valve body 43 is movable between the first position and the second position.

As shown in FIG. 2, a surface of the valve body 43 exposed to the ventilation port 38 when the valve body 43 is seated on the first valve seat 381 is referred to as a first pressure receiving surface 431. As shown in FIG. 3, a surface of the valve body 43 exposed to the atmospheric pressure chamber 33 when the valve body 43 is seated on the second valve seat 331 is referred to as a second pressure receiving surface 432. In this example, since an opening area of the second valve seat 331 is smaller than an opening area of the first valve seat 381, the second pressure receiving surface 432 is smaller than the first pressure receiving surface 431. For that reason, a force exerted on the valve body 43 by the differential pressure between the tank pressure chamber 34 and the atmospheric pressure chamber 33 when the valve body 43 is at the second position is smaller than a force exerted on the valve body 43 by the differential pressure between the second communication passage 28 and the tank pressure chamber 34 when the valve body 43 is at the first position. As described above, the second communication passage 28 communicates with the pressure passage 26. Therefore, the differential pressure between the atmospheric passage 24 and the pressure passage 26 when the valve body 43 is moved from the second position to the first position is smaller than the differential pressure between the atmospheric passage 24 and the pressure passage 26 when the valve body 43 is moved from the first position to the second position.

The differential pressure between the atmospheric passage 24 and the pressure passage 26 when the valve body 43 moves from the first position to the second position is referred to as operating pressure. The differential pressure between the atmospheric passage 24 and the pressure passage 26 when the valve body 43 moves from the second position to the first position is referred to as a return pressure.

Figure 4:
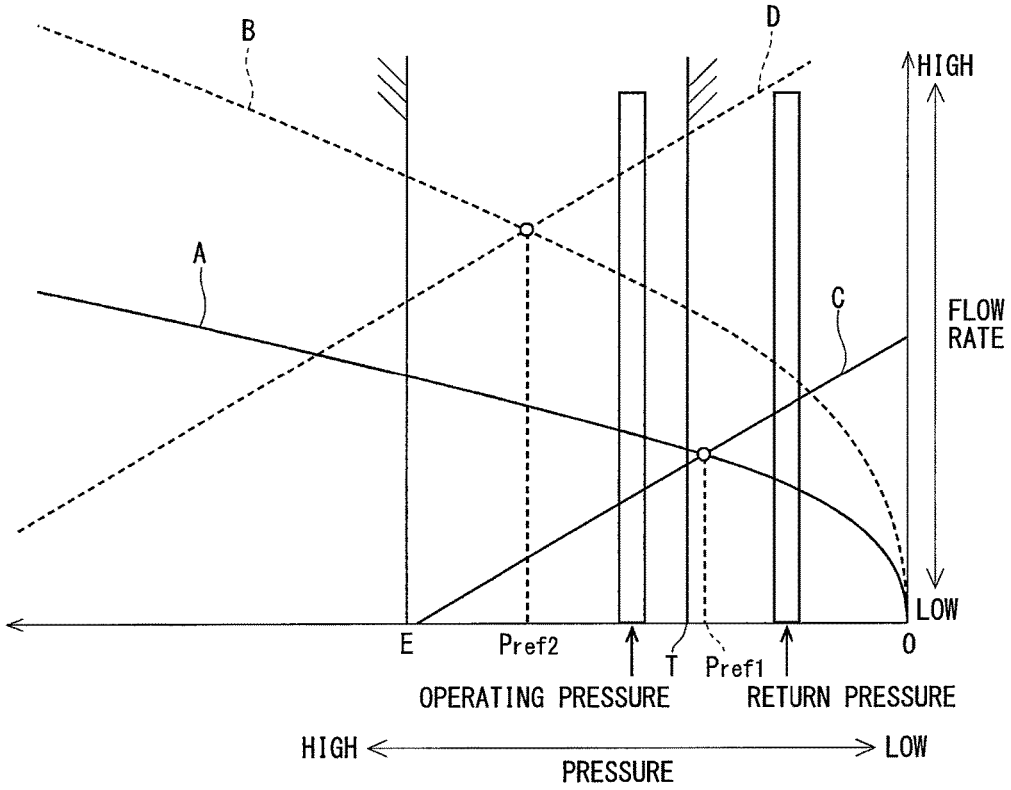
FIG. 4 is a graph showing a relationship between an operating pressure and a return pressure of the switching valve.

FIG. 4 shows a relationship between the operating pressure and the return pressure of the switching valve 30.

In FIG. 4, the horizontal axis shows a value smaller than zero. In addition, in FIG. 4 and the following description, when referring to a magnitude of the pressure unless otherwise specified, the magnitude refers to an absolute value of a relative pressure when the atmospheric pressure is assumed to be zero.

A solid line A in FIG. 4 shows a characteristic of a pressure of an air that passes through only the reference orifice 22 provided in the first communication passage 27 and a flow rate of the air. Hereinafter, the characteristic is referred to as a reference orifice characteristic.

A broken line B in FIG. 4 shows a characteristic of a pressure of an air that passes through both of the reference orifice 22 provided in the first communication passage 27 and the ventilation orifice 23 provided in the second communication passage 28, and a flow rate of the air. Hereinafter, the characteristic is referred to as a reference and ventilation orifice characteristic.

A solid line C in FIG. 4 shows a characteristic of a flow channel resistance and a flow rate of the flow channel when the pump 20 is rotated at a low speed.

A broken line D in FIG. 4 shows a characteristic of a flow channel resistance and a flow rate of the flow channel when the pump 20 is rotated at a high speed.

The low speed rotation of the pump 20 refers to a state in which a predetermined current is supplied to the motor of the pump 20 to rotate the impeller of the pump 20, or a state in which the motor or the impeller of the pump 20 is rotated at a predetermined rotational speed.

Further, the high speed rotation of the pump 20 refers to a state in which a predetermined current larger than that during the low speed rotation is supplied to the motor of the pump 20 to rotate the impeller of the pump 20, or a state in which the motor or the impeller of the pump 20 is rotated at a predetermined rotational speed higher than that during the low speed rotation.

The current value or the rotational speed to be supplied to the pump 20 can be appropriately set by experiments or the like. The rotational speed of the pump 20 during the high speed rotation is set to a rotational speed at which the fuel tank 8 does not collapse due to deformation or the like when the fuel tank 8 is reduced in pressure by driving the pump 20. In FIG. 4, a pressure at which the fuel tank 8 is crushed due to the deformation or the like is indicated by reference symbol E.

A pressure of the pump 20 during the low speed rotation in the reference orifice characteristic indicated by the solid line A is referred to as a first reference pressure Pref1. A leakage determination threshold set in consideration of the output error or the like of the pressure sensor 21 based on the first reference pressure Pref1 is indicated by reference symbol T.

Also, a pressure of the pump 20 during the high speed rotation in the reference and ventilation orifice characteristic indicated by the broken line B is referred to as a second reference pressure Pref2. The second reference pressure Pref2 is set to a value smaller than a pressure at which the fuel tank 8 is crushed due to the deformation or the like when the fuel tank 8 is reduced in pressure by driving the pump 20.

The operating pressure of the valve member 40 is set to be larger than the first reference pressure Pref1 or the leakage determination threshold T and smaller than the second reference pressure Pref2. Further, the return pressure of the valve member 40 is set to be smaller than the first reference pressure Pref1 or the leakage determination threshold value T, and larger than zero. As a result, the valve member 40 has a predetermined hysteresis between the operating pressure and the return pressure. In other words, when the differential pressure between the atmospheric passage 24 and the pressure passage 26 is larger than the first reference pressure Pref1 or the leakage determination threshold T, and smaller than the second reference pressure Pref2, the valve member 40 moves from the first position to the second position. On the other hand, when the differential pressure between the atmospheric passage 24 and the pressure passage 26 is smaller than the first reference pressure Pref1 or the leakage determination threshold T and greater than zero, the valve member 40 moves from the second position to the first position.

Figure 5:
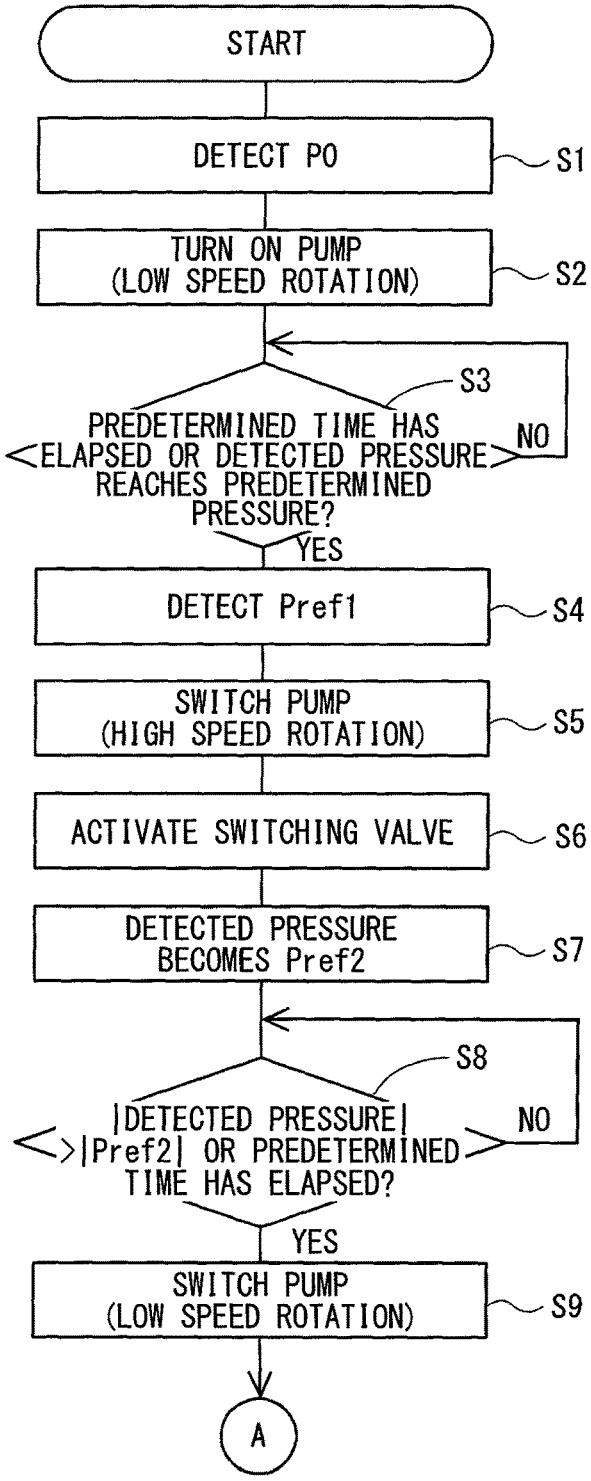
FIG. 5 is a flowchart of an inspection method of evaporated fuel leakage in the inspection apparatus according to the first embodiment of the present disclosure.

Next, an inspection method of the evaporated fuel leakage will be described with reference to flowcharts of FIGS. 5 and 6, a time chart of FIG. 7, and schematic diagrams and graphs of FIGS. 8 and 9.

Figure 7:
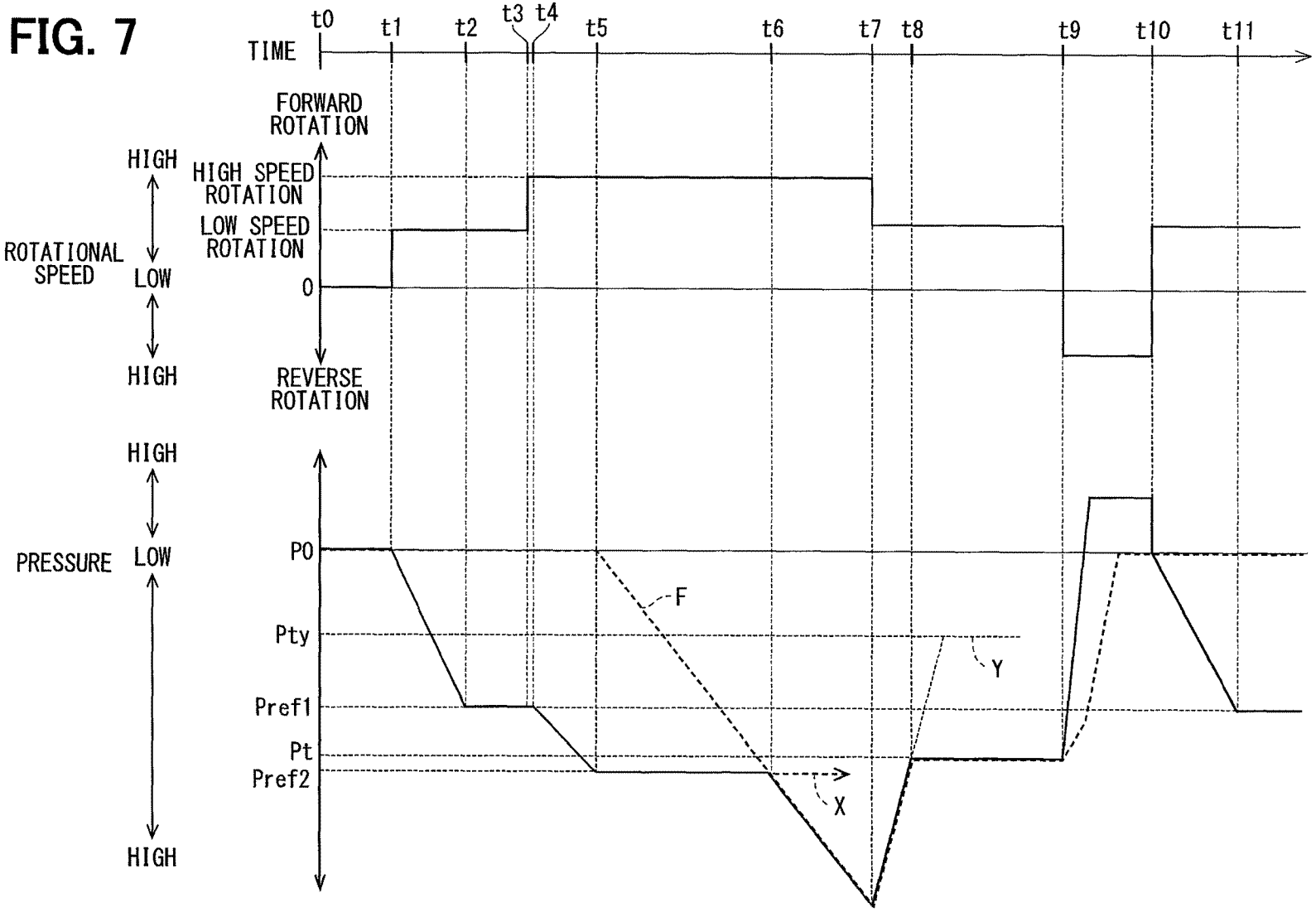
FIG. 7 is a time chart of an inspection of the evaporated fuel leakage in the inspection apparatus according to the first embodiment of the present disclosure.
Figure 8:
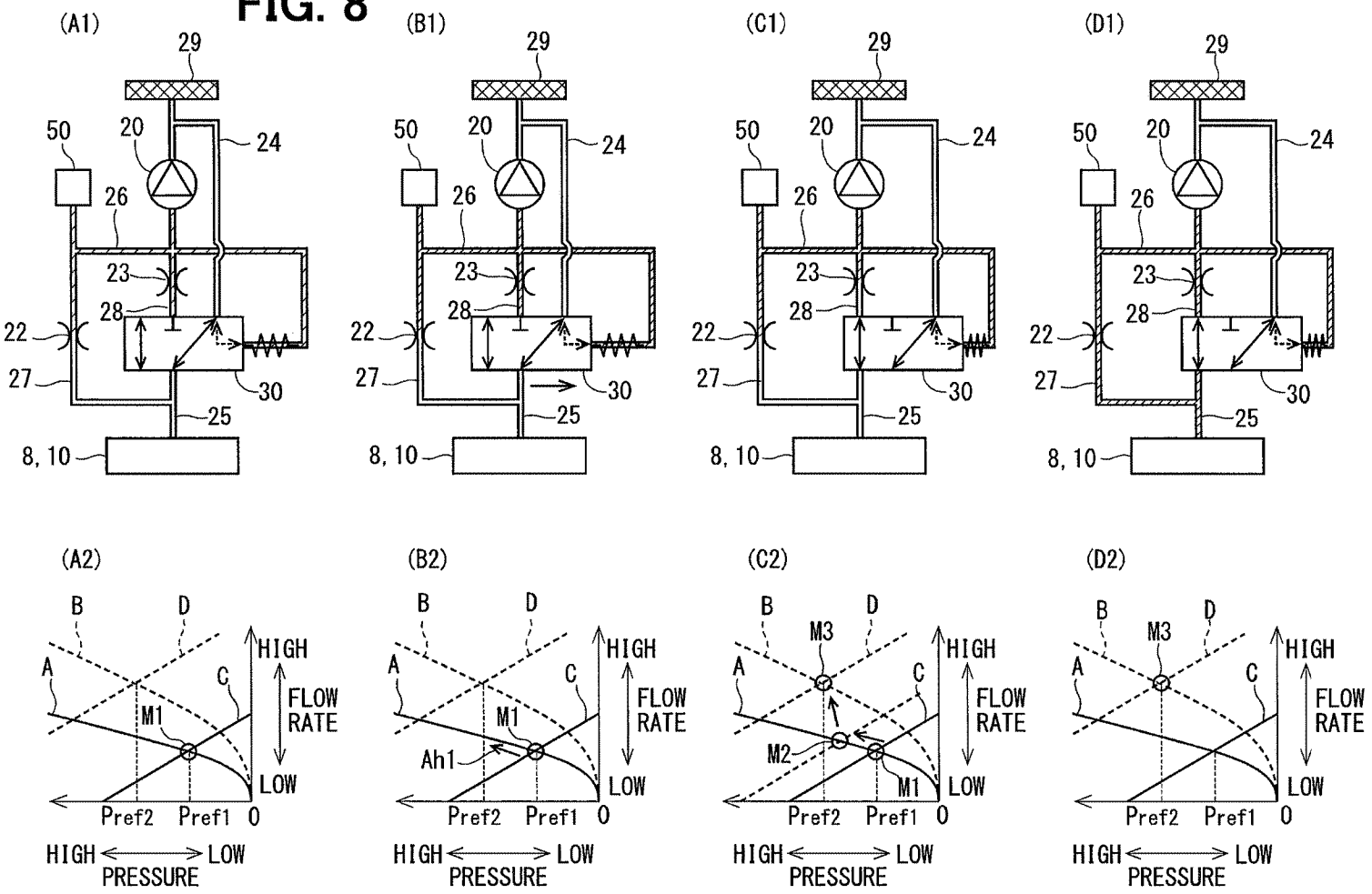
FIG. 8 is an illustrative view of respective stages of the inspection of the evaporated fuel leakage in the inspection apparatus according to the first embodiment of the present disclosure.

FIG. 7 shows a graph in which an upper stage shows a time axis in the inspection of the evaporated fuel leakage, a middle stage shows the rotational speed of the pump 20 with time, and a lower stage shows a change in a detected pressure of the pressure sensor 21 with time. It is assumed that the pump 20 reduces the pressure in the pressure passage 26 during a forward rotation. Similarly, when referring to the magnitude of the pressure, the magnitude is assumed to be an absolute value.

The inspection of the evaporated fuel leakage is started a predetermined time after the operation of the engine 2 has been stopped. The predetermined time is set to a time required for the temperature of the vehicle to stabilize.

In S1, the ECU 50 detects an atmospheric pressure P0. The process is performed in a state where the pump 20 is stopped at a time t0 to a time t1 in FIG. 7. At that time, the switching valve 30 is at the first position, and the pressure passage 26, the first communication passage 27, and the atmospheric passage 24 communicate with each other. For that reason, the pressure sensor 21 detects the atmospheric pressure P0 and transmits the detected atmospheric pressure P0 to the ECU 50. The ECU 50 corrects various parameters used for subsequent processing according to an altitude of the vehicle calculated based on the atmospheric pressure P0.

In S2, the ECU 50 drives the pump 20 at a low speed rotation. In the process, after the pump 20 has started to be driven at the low speed rotation at the time t1 in FIG. 7, the pressure detected by the pressure sensor 21 starts to decrease. At that time, the switching valve 30 shown in FIG. 8(A1) is in a state of the first position. In FIG. 8(A1), a flow channel that is reduced in pressure by driving the pump 20 is hatched. The air flows through the reference orifice 22 of the first communication passage 27 that communicates with the pressure passage 26 by driving the pump 20.

In S3, the ECU 50 determines whether a predetermined time has elapsed from a start of driving of the pump 20, or not. The ECU 50 repeats the process of S3 until the predetermined time has elapsed. In that process, the detected pressure of the pressure sensor 21 which has decreased after the time t1 in FIG. 7 reaches the first reference pressure Pref1 at the time t2. After the time t2, the first reference pressure Pref1 is maintained.

In S3, instead of or in addition to determining the elapse of the predetermined time, the ECU 50 may perform a process of determining whether the detected pressure of the pressure sensor 21 reaches a predetermined pressure and is maintained at the predetermined pressure, or not. In that case, the ECU 50 repeats the process of S3 until the detected pressure of the pressure sensor 21 reaches the predetermined pressure.

In S4, the ECU 50 stores the detected pressure of the pressure sensor 21 as the first reference pressure Pref1. The process is performed between the time t2 and a time t3 in FIG. 7. The flow rate characteristic at that time is indicated by a symbol M1 in the graph of FIG. 8(A2).

In S5, the ECU 50 switches the driving of the pump 20 to the high speed rotation. In that process, the pump 20 is switched to the high speed rotation at the time t3 in FIG. 7. At that time, a flow channel hatched in FIG. 8(B1) is reduced in pressure, and the switching valve 30 starts switching operation. The flow rate characteristic at that time shifts from the symbol M1 indicated in the graph of FIG. 8(B2) to a direction in which the flow rate and the pressure increase along the solid line A (a direction of a solid line arrow Ah1 in FIG. 8(B2)).

In S6, the switching valve 30 is switched from the first position to the second position. In other words, as shown in FIG. 8(C1), the switching valve 30 is in a state of the second position. With the process, the detected pressure of the pressure sensor 21 decreases after a time t4 in FIG. 7. The flow rate characteristic at that time shifts from the characteristic indicated by the symbol M1 to the characteristic indicated by a symbol M3 through the characteristic indicated by a symbol M2 in the graph of FIG. 8(C2).

In S7, the detected pressure of the pressure sensor 21 becomes the second reference pressure Pref2. In this process, after a time t5 in FIG. 7, the detected pressure of the pressure sensor 21 is maintained at the second reference pressure Pref2. After the time t5, as indicated by a broken line F, the pressure in the canister 10 and the fuel tank 8 is also reduced, and approaches the second reference pressure Pref2. At that time, a flow channel hatched in FIG. 8(D1) is reduced in pressure, and the pressure in the canister 10 and the fuel tank 8 are also reduced. The flow rate characteristic at that time is indicated by the symbol M3 in the graph of FIG. 8(D2).

In S8, the ECU 50 determines whether a predetermined time has elapsed after the detected pressure of the pressure sensor 21 has reached the second reference pressure Pref2, or not. The ECU 50 repeats the processing of S8 until the predetermined time has elapsed.

In S8, the ECU 50 may perform a process of determining whether the detected pressure of the pressure sensor 21 has become larger than the second reference pressure Pref2, or not, instead of or in addition to the process of determining the elapse of the predetermined time. In that case, the ECU 50 repeats the processing of S8 until the detected pressure of the pressure sensor 21 becomes larger than the second reference pressure Pref2. The ECU 50 may also perform a process of determining whether a predetermined time has elapsed after the pump has switched to the high speed rotation.

Figure 9:
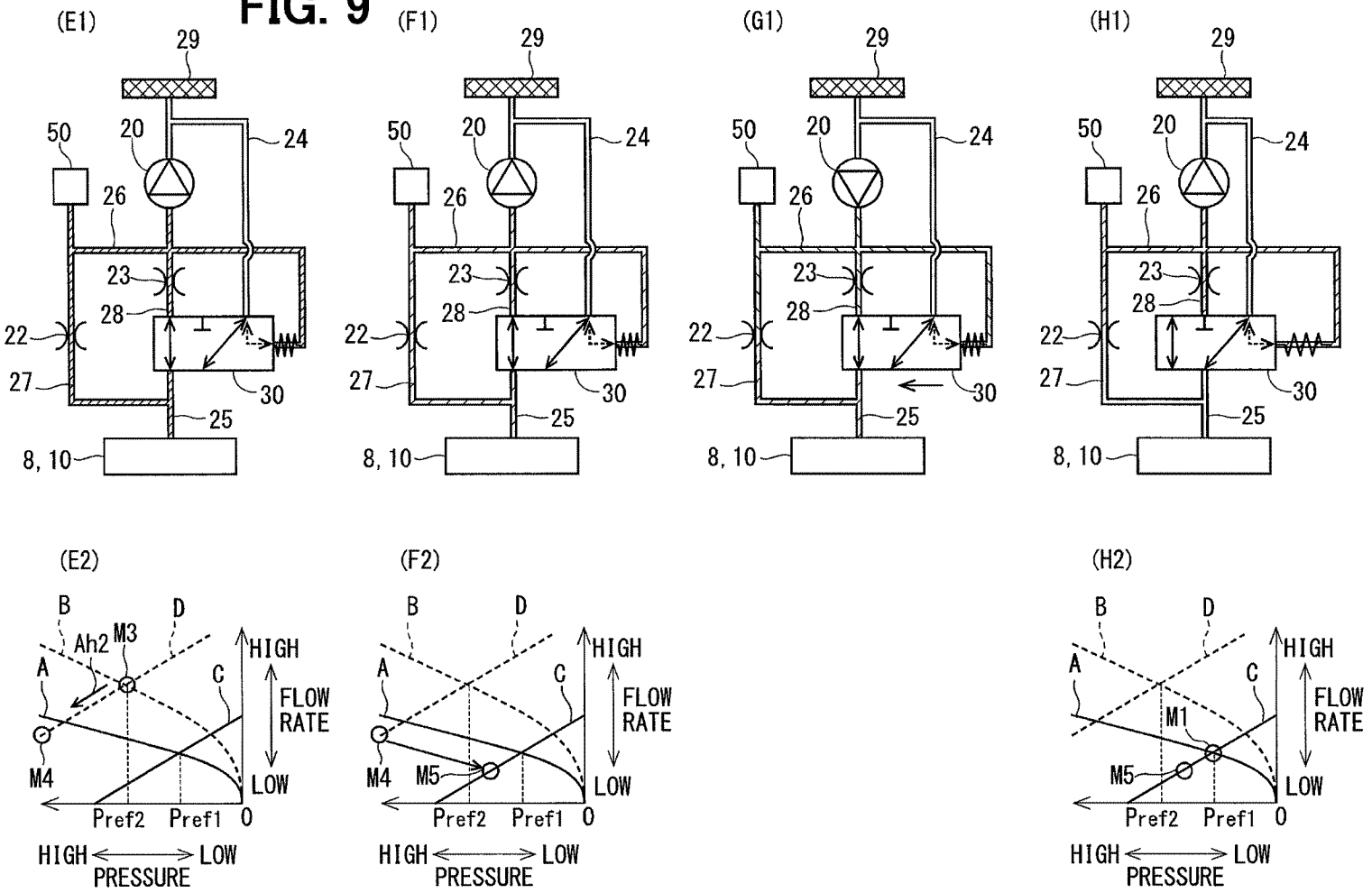
FIG. 9 is an illustrative view of respective stages of the inspection of the evaporated fuel leakage in the inspection apparatus according to the first embodiment of the present disclosure.

In the process of S8, a flow channel hatched in FIG. 9(E1) is further reduced in pressure, and the pressure in the canister 10 and the fuel tank 8 are further reduced. As a result, when the fuel tank 8 or the canister 10 has a hole smaller than a total of a cross-sectional area of the reference orifice 22 and a cross-sectional area of the ventilation orifice 23, or when no hole is provided in the fuel tank 8 or the canister 10, the detected pressure of the pressure sensor 21 falls below the second reference pressure Pref2 after a time t6 in FIG. 7. The flow rate characteristic at that time shifts from the characteristic indicated by the symbol M3 to a characteristic indicated by a symbol M4 along a solid line arrow Ah2 in the graph of FIG. 9(E2).

On the other hand, when the fuel tank 8 or the canister 10 has a hole larger than the total of the cross-sectional area of the reference orifice 22 and the cross-sectional area of the ventilation orifice 23, the detected pressure is maintained at the second reference pressure Pref2 as indicated by a broken line X in the graph of the detected pressure of the pressure sensor 21 in FIG. 7.

The ECU 50 shifts the processing to S9 the predetermined time after the detected pressure of the pressure sensor 21 has reached the second reference pressure Pref2.

In S9, the ECU 50 switches the driving of the pump 20 to the low speed rotation. In this process, the pump 20 is switched to the low speed rotation at a time t7 in FIG. 7, and thereafter the detected pressure decreases. At that time, the pressure of the flow channel hatched in FIG. 9(F1) becomes small, but the switching valve 30 is maintained in the state of the second position without switching. The flow rate characteristic at that time is shifted from the characteristic indicated by the symbol M4 to the characteristic indicated by a symbol M5 in the graph of FIG. 9(F2).

In S10, the ECU 50 determines whether a predetermined time has elapsed after the driving of the pump 20 has been switched to the low speed rotation, or not. The ECU 50 repeats the processing of S10 until the predetermined time has elapsed. In this process, after a time t8 in FIG. 7, the detected pressure of the pressure sensor 21 is maintained at a constant pressure. The flow rate characteristic at that time is indicated by the symbol M5 in the graph of FIG. 9(F2).

In S10, the ECU 50 may perform a process of determining whether the detected pressure of the pressure sensor 21 has been maintained at a predetermined pressure, or not, instead of or in addition to the process of determining the elapse of the predetermined time. In that case, the ECU 50 repeats the process of S10 until the detected pressure of the pressure sensor 21 is maintained at the predetermined pressure.

In S11, the ECU 50 stores the detected pressure of the pressure sensor 21 as a system pressure Pt. The process is performed between the time t8 and a time t9 in FIG. 7. In the present disclosure, the system pressure refers to a pressure detected by the pressure sensor 21 when the pump 20 is rotated at a low speed in a state in which the switching valve 30 shuts off the communication of the atmospheric passage 24 with other than the pump 20 and the atmosphere, and communicates the second communication passage 28 with the tank passage 25.

In S12, the ECU 50 compares the first reference pressure Pref1 with the system pressure Pt. When the absolute value of the system pressure Pt is larger than the absolute value of the first reference pressure Pref1 and a difference between the absolute value of the system pressure Pt and the absolute value of the first reference pressure Pref1 is larger than a predetermined threshold, the ECU 50 shifts the processing to S13. The predetermined threshold is a value set in consideration of an output error of the pressure sensor 21 and the like, which is a difference between the leakage determination threshold T and the first reference pressure Pref1.

In S13, the ECU 50 determines that the hole of the evaporated fuel leakage from the fuel tank 8 or the canister 10 is smaller than the reference value. The reference value is a value corresponding to the cross-sectional area of the reference orifice 22.

On the other hand, when the absolute value of the system pressure Pt is equal to or smaller than the absolute value of the first reference pressure Pref1 or when the difference between the absolute value of the system pressure Pt and the absolute value of the first reference pressure Pref1 is equal to or smaller than the predetermined threshold in S12, the ECU 50 shifts the processing to S14. This is a case where the detected pressure of the pressure sensor 21 is indicated by a broken line Y (system pressure Pty shown in FIG. 7) in the graph on a lower stage of FIG. 7.

In S14, the ECU 50 determines that the evaporated fuel leakage from the fuel tank 8 or the canister 10 is larger than a reference value.

In S15, the ECU 50 performs a process of turning on a warning lamp of an instrument panel during next engine operation.

In S16, the ECU 50 stops driving the pump 20 or rotates the impeller of the pump 20 in a reverse direction. In both of those cases, the detected pressure decreases after the time t9 in FIG. 7.

When the impeller of the pump 20 is reversely rotated as indicated by a solid line after the time t9 in FIG. 7, a flow channel hatched in FIG. 9(G1) is increased in pressure and a differential pressure between the pressure passage 26 and the atmospheric passage 24 becomes smaller than the return pressure of the switching valve 30. Then, the switching valve 30 starts the switching operation from the second position to the first position.

When the driving of the pump 20 is stopped, when the pressure of the flow channel hatched in FIG. 9(G1) approaches zero and the differential pressure between the pressure passage 26 and the atmospheric passage 24 becomes smaller than the return pressure of the switching valve 30. Then, the switching valve 30 starts the switching operation from the second position to the first position.

When the switching valve 30 is switched to the first position, the ECU 50 stops driving the pump 20 in S17 and completes the processing.

After the switching valve 30 is switched to the first position, the ECU 50 may drive the pump 20 to rotate at a low speed in a forward direction. When this processing is performed, the pressure detected by the pressure sensor 21 decreases after a time t10 in FIG. 7, and the first reference pressure Pref1 is maintained after a time t11. At this time, the flow channel hatched in FIG. 9(H1) is reduced in pressure, and the air flows through the reference orifice 22 of the first communication passage 27 that communicates with the pressure passage 26. The flow rate characteristic at that time is shifted from the characteristic indicated by the symbol M5 to the characteristic indicated by the symbol M1 in the graph of FIG. 9(H2). At this time, the ECU 50 compares the first reference pressure Pref1 detected after the time t11 with the first reference pressure Pref1 detected in S4, and determines whether an error between those values falls within a predetermined range, or not.

The ECU 50 may again measure the atmospheric pressure P0, and compare the detection value with the atmospheric pressure P0 detected in S1 to determine whether the error of those values fall within the predetermined range.

When one or both of those errors fall within the predetermined range, the ECU 50 completes the processing. On the other hand, when one or both of those errors is larger than the predetermined range, the ECU 50 discards the determination made in S13 to S15.

In the inspection method described above, the processing from S2 to S4 corresponds to a first reference pressure detection step, the processing from S5 to S8 corresponds to a tank pressure reduction step, the processing from S9 to S11 corresponds to a system pressure detection step, and the processing from S12 to S14 corresponds to a determination step.

The inspection apparatus 1 or the inspection method according to the first embodiment has the following effects.

(1) The inspection apparatus 1 according to the first embodiment is provided with the switching valve 30 that operates according to the differential pressure between the pressure passage 26 and the atmospheric passage 24, thereby being capable of eliminating the electromagnetic valve provided in a conventional inspection apparatus 1. Therefore, the inspection apparatus 1 can be simplified in the structure and reduced in the body size. Further, since the inspection apparatus 1 does not use an electromagnetic valve, power consumption can be reduced.

Furthermore, according to the inspection apparatus 1, by virtue of the flow channel configuration of the inspection apparatus 1, the pressure in the pressure passage 26 is reduced by driving the pump 20, thereby being capable of detecting both of the reference pressure caused by the reference orifice 22, that is, the first reference pressure Pref1 and the system pressure Pt at the time of reducing the pressure in the fuel tank 8. Therefore, according to the inspection apparatus 1, since both of the reference pressure and the system pressure Pt can be detected in the same rotational direction of the impeller of the pump 20, the detection accuracy can be improved.

(2) In the switching valve 30 of the inspection apparatus 1 according to the first embodiment, the pressure chamber 32, the atmospheric pressure chamber 33, and the tank pressure chamber 34 are provided inside the housing 31. The valve member 40 operates according to the differential pressure between the pressure chamber 32 and the atmospheric pressure chamber 33. With the configuration of the switching valve 30, the differential pressure between the pressure chamber 32 and the atmospheric pressure chamber 33 can be changed under the control of the rotational speed of the pump 20, thereby being capable of operating the valve member 40.

(3) In the first embodiment, in the valve member 40 provided in the switching valve 30, the absolute value of the differential pressure between the pressure chamber 32 and the atmospheric pressure chamber 33 when the valve member 40 moves from the second position to the first position is smaller than the absolute value of the differential pressure between the pressure chamber 32 and the atmospheric pressure chamber 33 when the valve member 40 moves from the first position to the second position.

As a result, even when the absolute value of the differential pressure between the pressure chamber 32 and the atmospheric pressure chamber 33 is reduced after the pump 20 is rotated at a high speed to bring the valve member 40 into the state of the second position, the valve member 40 can be retained at the second position. For that reason, with the valve member 40 placed at the second position, the system pressure Pt can be detected by rotating the pump 20 at a low speed.

(4) In the first embodiment, the valve member 40 provided in the switching valve 30 includes the diaphragm 42 and the valve body 43 that operates together with the diaphragm 42. The second pressure receiving surface 432 exposed to the atmosphere port 36 when the valve body 43 is seated on the second valve seat 331 is smaller than the first pressure receiving surface 431 exposed to the ventilation port 38 when the valve body 43 is seated on the first valve seat 381.

As a result, the force exerted on the valve body 43 due to the differential pressure between the tank pressure chamber 34 and the atmospheric pressure chamber 33 when the valve member 40 is at the second position is smaller than the force exerted on the valve body 43 due to the differential pressure between the tank pressure chamber 34 and the second communication passage 28 when the valve member 40 is at the first position. Therefore, the switching valve 30 can reduce the absolute value of the return pressure more than the absolute value of the operating pressure.

(5) In the first embodiment, when the absolute value of the operating pressure of the switching valve 30 is set to be larger than the absolute value of the first reference pressure Pref1 or the absolute value of the leakage determination threshold (T), and smaller than the absolute value of the second reference pressure Pref2.

As a result, after the first reference pressure Pref1 has been measured, the valve member 40 is moved from the first position to the second position, thereby being capable of reducing the pressure of the tank in a short time.

In addition, in the first embodiment, the absolute value of the return pressure of the switching valve 30 is set to be smaller than the absolute value of the first reference pressure Pref1 or the absolute value of the leakage determination threshold (T), and larger than zero.

As a result, the pump 20 can be rotated at the low speed to measure the system pressure Pt with the valve member 40 held at the second position.

(6) The inspection apparatus 1 according to the first embodiment includes the ventilation orifice 23 in the second communication passage 28.

While the valve member 40 of the switching valve 30 is moving between the first position and the second position, the ventilation orifice 23 prevents the air from flowing into the pressure chamber 32 from the pressure introduction port 35 from the atmospheric passage 24 and the tank passage 25 through the second communication passage 28 and the pressure passage 26. Therefore, the ventilation orifice 23 can guarantee the operation of the valve member 40.

(7) The evaporated fuel leakage inspection method according to the first embodiment includes the first reference pressure detection step (S2 to S4), the tank pressure reduction step (S5 to S8), the system pressure detection step (S9 to S11), and the determination step (S12 to S14).

With the above steps, in the inspection method of the evaporated fuel leakage, the operation of the switching valve 30 can be controlled by changing the rotational speed of the pump 20. Further, in the inspection method, the pump 20 is rotated at a high speed to reduce the pressure in the fuel tank 8 and the canister 10, thereby being capable of completing the evaporated fuel leakage inspection in a short time. Therefore, the inspection method can reduce the electric power consumed for the evaporated fuel leakage inspection.

Second Embodiment

Figure 10:
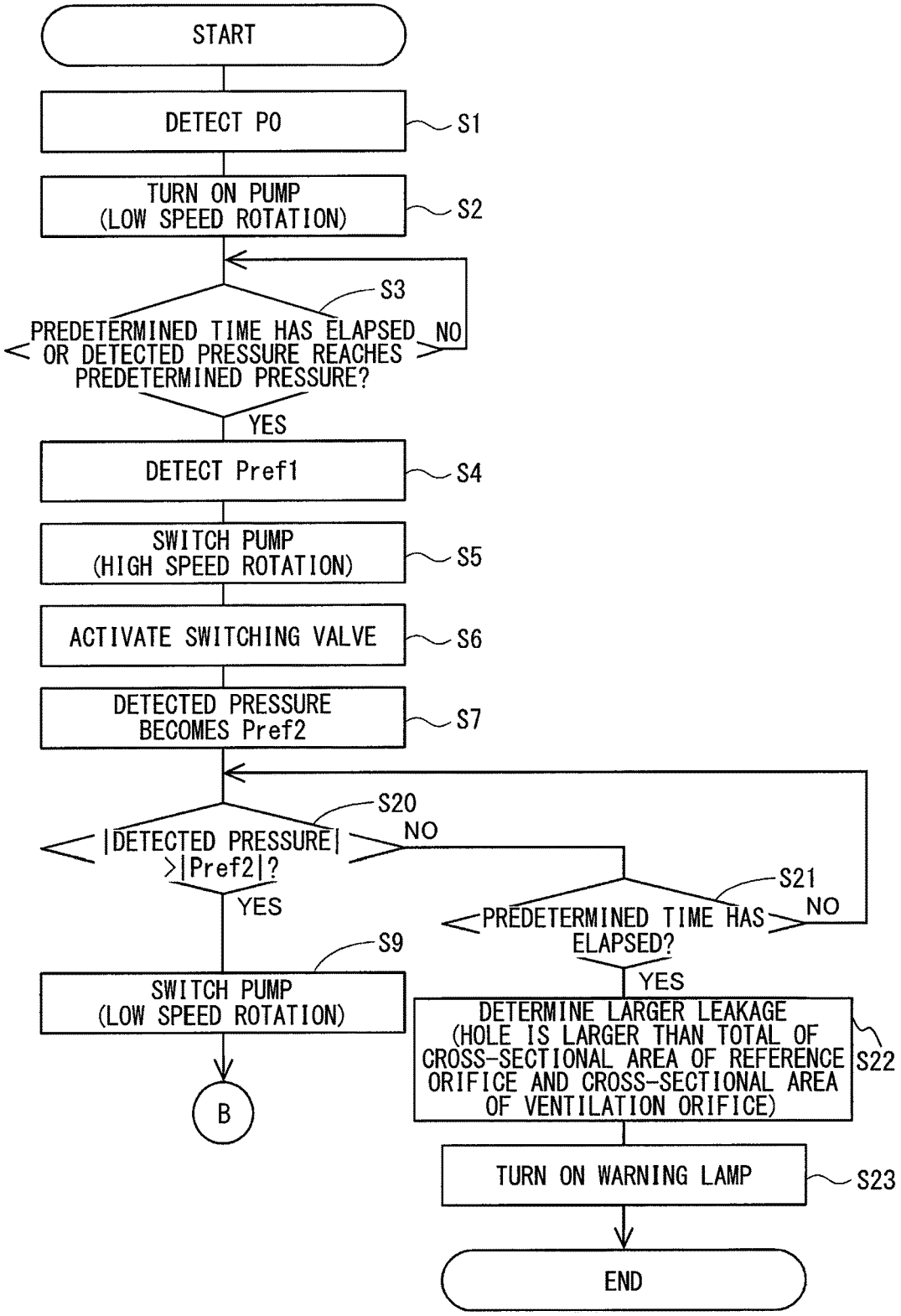
FIG. 10 is a flowchart of an inspection method in the inspection apparatus according to a second embodiment of the present disclosure.
Figure 11:
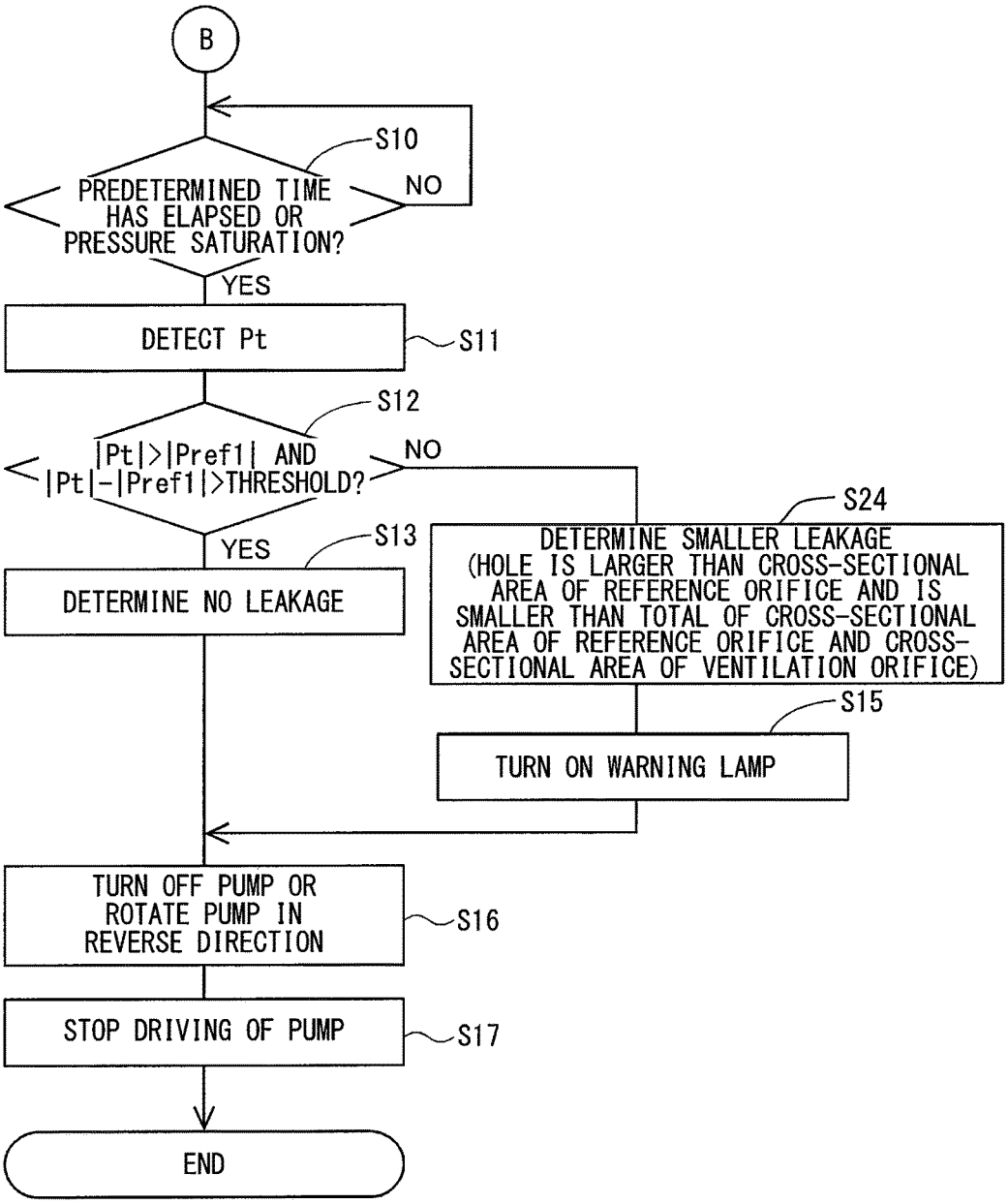
FIG. 11 is a flowchart of the inspection method in the inspection apparatus according to the second embodiment of the present disclosure.

An inspection method of an evaporated fuel leakage according to a second embodiment of the present disclosure will be described with reference to flowcharts of FIGS. 10 and 11.

In the inspection method according to the second embodiment, the processing from S1 to S7 is the same as the processing of the first embodiment.

In the second embodiment, in S20 subsequent to S7, the ECU 50 determines whether a detected pressure of the pressure sensor 21 has become larger than a second reference pressure Pref2, or not. When the ECU 50 determines that the detected pressure of the pressure sensor 21 is larger than the second reference pressure Pref2 in S20, the ECU 50 moves the processing to S9.

On the other hand, when the ECU 50 determines that the detected pressure of the pressure sensor 21 is equal to or smaller than the second reference pressure Pref2 in S20, the ECU 50 moves the processing to S21, and determines whether a predetermined time has elapsed after the detected pressure of the pressure sensor 21 has reached the second reference pressure Pref2, or not. When the predetermined time has not elapsed in S21, the ECU 50 returns the processing to S20.

On the other hand, the ECU 50 shifts the processing to S22 when the predetermined time has elapsed after the detected pressure of the pressure sensor 21 has reached the second reference pressure Pref2 in S21. In this example, the predetermined time is set to a time during which the pressure in the fuel tank 8 and the canister 10 can be sufficiently reduced by driving the pump 20.

In S22, the ECU 50 determines that a hole larger than a total of a cross-sectional area of the reference orifice 22 and a cross-sectional area of the ventilation orifice 23 is opened in the fuel tank 8 or the canister 10. In the second embodiment, the total of the cross-sectional area of the reference orifice 22 and the cross-sectional area of the ventilation orifice 23 is referred to as a large diameter reference value. On the other hand, the cross-sectional area of the reference orifice 22 is referred to as a small diameter reference value.

In S23, the ECU 50 performs a process of turning on a warning lamp of an instrument panel during next engine operation, and completes the processing.

As described above, when the ECU 50 determines that the detected pressure of the pressure sensor 21 is larger than the second reference pressure Pref2 in S20, the ECU 50 moves the processing to S9. The subsequent processing from S9 to YES determination in S12 is the same as the processing of the first embodiment.

When the absolute value of the system pressure Pt is equal to or smaller than the absolute value of a first reference pressure Pref1 or the difference between the absolute value of the system pressure Pt and the absolute value of the first reference pressure Pref1 is smaller than a predetermined threshold in S12, the ECU 50 shifts the processing to S24.

In S24, the ECU 50 determines that the evaporated fuel leakage from the fuel tank 8 or the canister 10 is larger than the small diameter reference value and smaller than the large diameter reference value. Then, in S15, the ECU 50 performs a process of turning on a warning lamp of an instrument panel during next engine operation.

The subsequent processing from S16 and S17 is the same as the processing of the first embodiment.

In the inspection method described above, the processing from S20 to S22 corresponds to a large diameter determination step, and the processing at S12, S13 and S24 corresponds to a small diameter determination step.

In the inspection method according to the second embodiment, the evaporated fuel leakage larger than the large diameter reference value can be detected in the large diameter determination step. In addition, the evaporated fuel leakage between the small diameter reference value and the large diameter reference value can be detected in the small diameter determination step.

Third Embodiment

Figure 12:
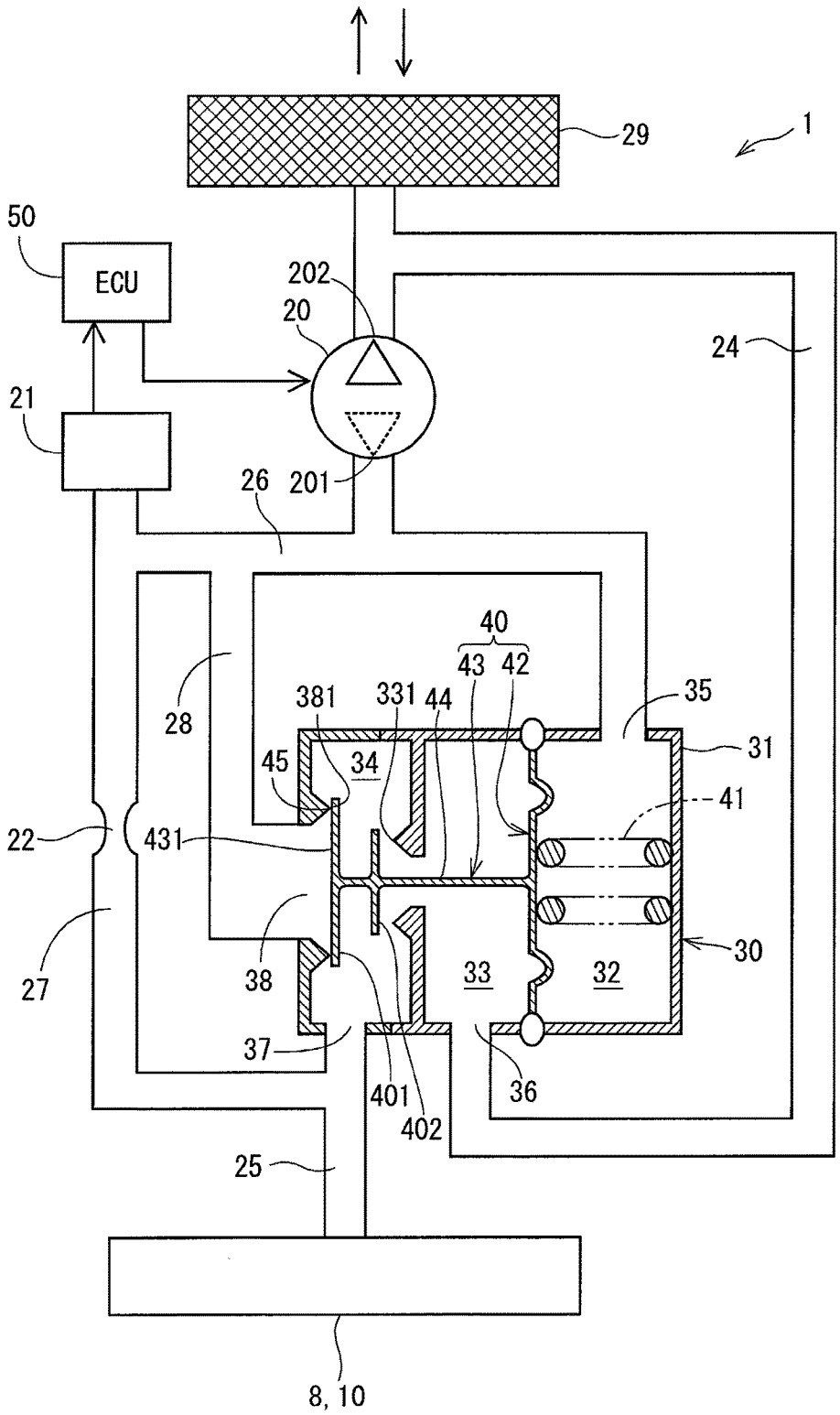
FIG. 12 is a schematic diagram of the inspection apparatus according to a third embodiment of the present disclosure.

FIG. 12 shows the inspection apparatus 1 according to a third embodiment of the present disclosure. In the third embodiment, the valve member 40 of the switching valve 30 has a first valve body 401 and a second valve body 402. The first valve body 401 can be seated on and separated from the first valve seat 381, and the second valve body 402 can be seated on and separated from the second valve seat 331. The first valve body 401 and the second valve body 402 are spaced apart from each other by a predetermined distance. As a result, a time required for the valve member 40 to move in order to switch over the switching valve 30 between a first position and a second position can be shortened. For that reason, while the valve member 40 is moving between the first position and the second position, the switching valve 30 can reduce a flow rate of an air flowing into the tank pressure chamber 34 from the atmospheric passage 24 and the tank passage 25, which flows into the pressure chamber 32 from the pressure introduction port 35 from the ventilation port 38 through the second communication passage 28 and the pressure passage 26. Therefore, the switching valve 30 can guarantee the operation of the valve member 40.

A time during which the valve member 40 moves between the first position and the second position is shortened, thereby being capable of eliminating the ventilation orifice 23 of the second communication passage 28. In addition, a flow channel cross-sectional area of the second communication passage 28 can be adjusted to provide the second communication passage 28 with the same function as that of the ventilation orifice 23.

Fourth Embodiment

Figure 13:
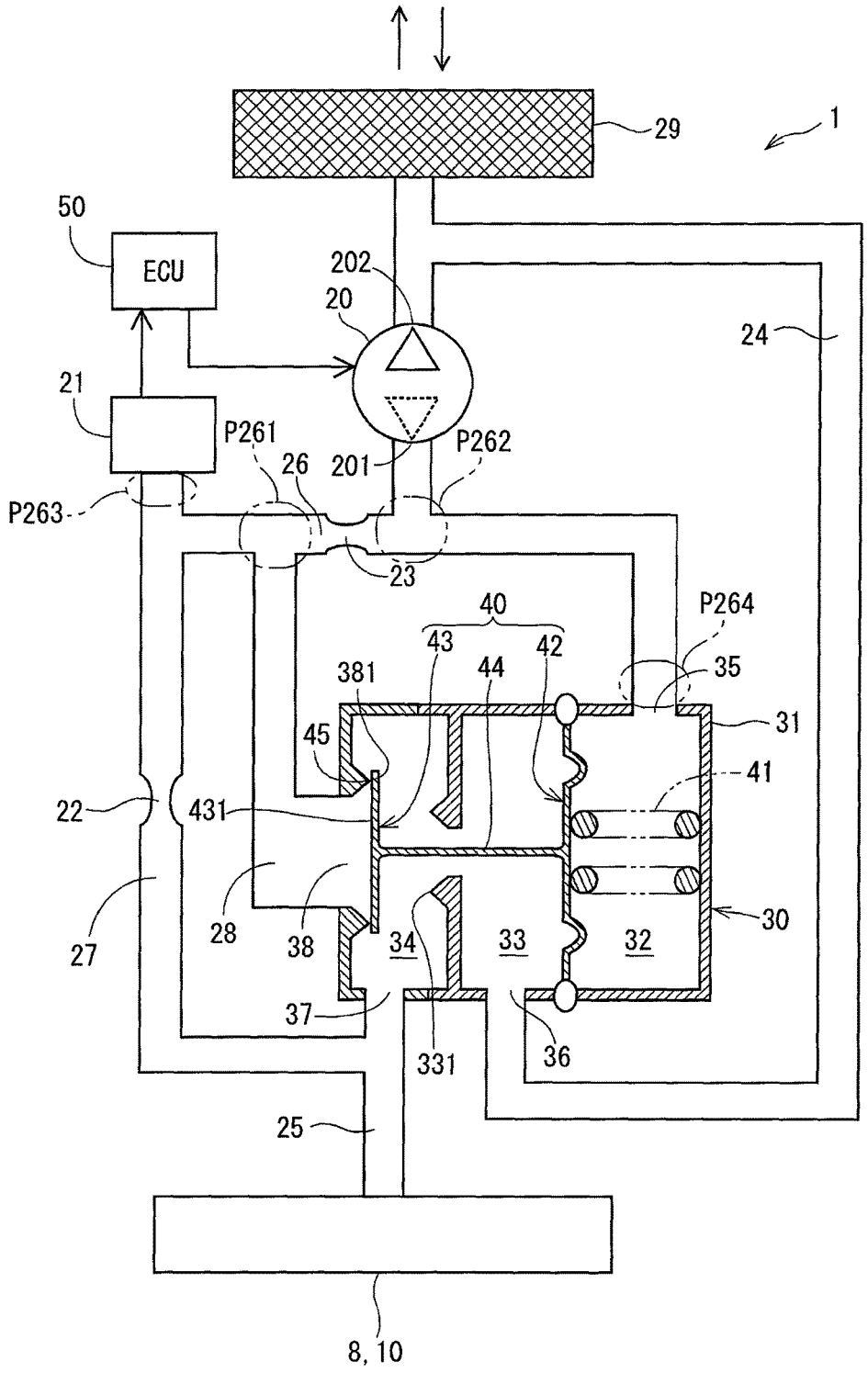
FIG. 13 is a schematic diagram of the inspection apparatus according to a fourth embodiment of the present disclosure.

FIG. 13 shows the inspection apparatus 1 according to a fourth embodiment of the present disclosure. In the fourth embodiment, the ventilation orifice 23 is provided between the second communication passage 28 of the pressure passage 26 and the intake port 201. More specifically, as shown in FIG. 13, when the pressure passage 26 communicates with the intake port 201 of the pump 20, the second communication passage 28, and the first communication passage 27 in order from the pressure introduction port 35, the ventilation orifice 23 is provided between a portion P261 that is connected to the second communication passage 28 of the pressure passage 26 and a portion P262 that is connected to the intake port 201 of the pressure passage 26. At this time, a cross-sectional area of the ventilation orifice 23 is larger than a cross-sectional area of the reference orifice 22.

Next, an inspection method of an evaporated fuel leakage according to the fourth embodiment will be described with reference to a flowchart of FIG. 14 and a time chart of FIG. 15. The inspection method of the evaporated fuel leakage according to the fourth embodiment is performed along flowcharts of FIGS. 14 and 6. FIG. 15 shows a graph in which an upper stage shows a time axis in the inspection of the evaporated fuel leakage, a middle stage shows the rotational speed of the pump 20 with time, and a lower stage shows a change in a detected pressure of the pressure sensor 21 with time. It is assumed that the pump 20 reduces the pressure in the pressure passage 26 during a forward rotation. Similarly, when referring to the magnitude of the pressure, the magnitude is assumed to be an absolute value.

In the inspection method according to the fourth embodiment, the processing from S1 to S6 is the same as the processing of the first embodiment. When the driving of the pump 20 is switched to a high speed rotation at S5, the detected pressure of the pressure sensor 21 gradually decreases after a time t4 in FIG. 15. When the detected pressure of the pressure sensor 21 reaches an operating pressure, the valve member 40 starts to move from the first position to the second position (S6). In the fourth embodiment, when the valve member 40 starts to move, the detected pressure of the pressure sensor 21 temporarily returns to the atmospheric pressure at a time t5 in FIG. 15, and thereafter changes like a pressure waveform (broken line F) in the canister 10 and the fuel tank 8. In this situation, when the fuel tank 8 or the canister 10 has a hole larger than the total of the cross-sectional area of the reference orifice 22 and the cross-sectional area of the ventilation orifice 23, the detected pressure is kept constant to a pressure corresponding to the area of the hole as indicated by a broken line X in FIG. 15.

In S40, the ECU 50 determines whether a predetermined time has elapsed after the detected pressure of the pressure sensor 21 has reached a target value, or not. The ECU 50 repeats the processing of S40 until the predetermined time has elapsed. In this example, the target value in S40 is determined according to a pressure resistance of the fuel tank 8 or a size of the hole to be detected.

In S40, the ECU 50 may perform a process of determining whether the detected pressure of the pressure sensor 21 has become larger than the target value, or not, instead of or in addition to the process of determining the elapse of the predetermined time. In that case, the ECU 50 repeats the processing of S40 until the detected pressure of the pressure sensor 21 becomes larger than the target value. The ECU 50 may also perform a process of determining whether a predetermined time has elapsed after the pump has switched to the high speed rotation.

The ECU 50 shifts the processing to S9 the predetermined time after the detected pressure of the pressure sensor 21 has reached the target value.

The subsequent processing from S9 to S17 is the same as the processing of the first embodiment.

In the inspection apparatus 1, when the valve body 43 is at the second position, the atmospheric pressure chamber 33 communicates with the pressure chamber 32 through the second communication passage 28 and the pressure passage 26. At this time, a differential pressure between the pressure chamber 32 and the atmospheric pressure chamber 33 can be generated by the ventilation orifice 23. As a result, a state where the valve body 43 is at the second position can be maintained.

When a system pressure Pt is detected, the pressure passage 26 in the vicinity of the pressure sensor 21 communicates with the inside of the fuel tank 8 and the inside of the canister 10 through the pressure passage 26 extending from a portion P263 of the pressure passage 26 which is connected to the pressure sensor 21 to the portion P261 of the pressure passage 26 which is connected to the second communication passage 28, the second communication passage 28, the tank pressure chamber 34, and the tank passage 25. In the inspection apparatus 1 according to the fourth embodiment, the pressure passage 26 extending from the portion P263 of the pressure passage 26 which is connected to the pressure sensor 21 to the portion P261 of the pressure passage 26 which is connected to the second communication passage 28, and the second communication passage 28 have no portion that serves as a resistance against a gas flow such as the ventilation orifice 23. Therefore, a leakage in the canister 10 and the fuel tank 8 can be detected with high accuracy.

Fifth Embodiment

Figure 16:
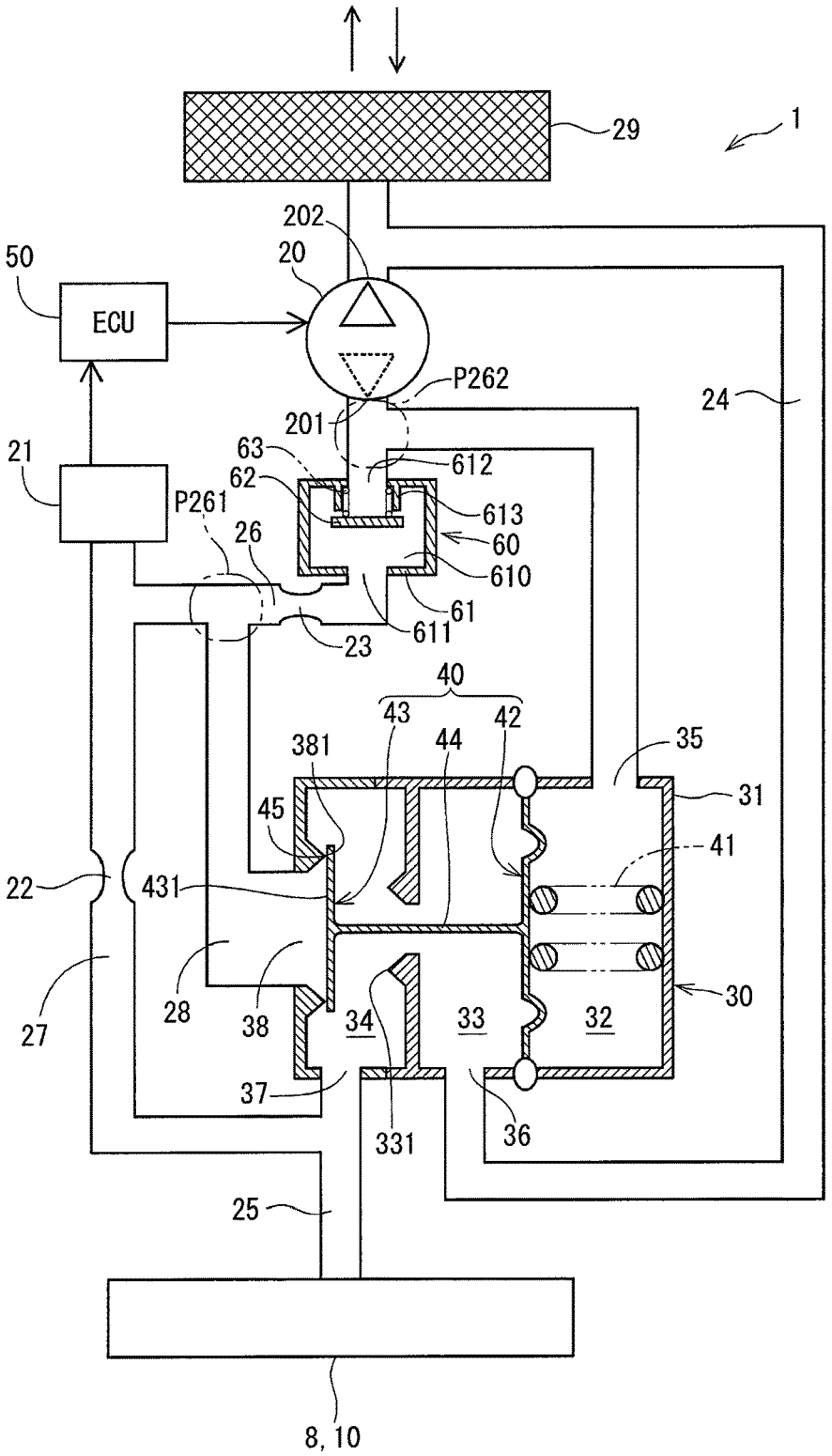
FIG. 16 is a schematic diagram of the inspection apparatus according to a fifth embodiment of the present disclosure.

FIG. 16 shows the inspection apparatus 1 according to a fifth embodiment of the present disclosure. In the fifth embodiment, a check valve 60 is provided on the pressure passage 26 between the ventilation orifice 23 and the pump 20.

Figure 14:
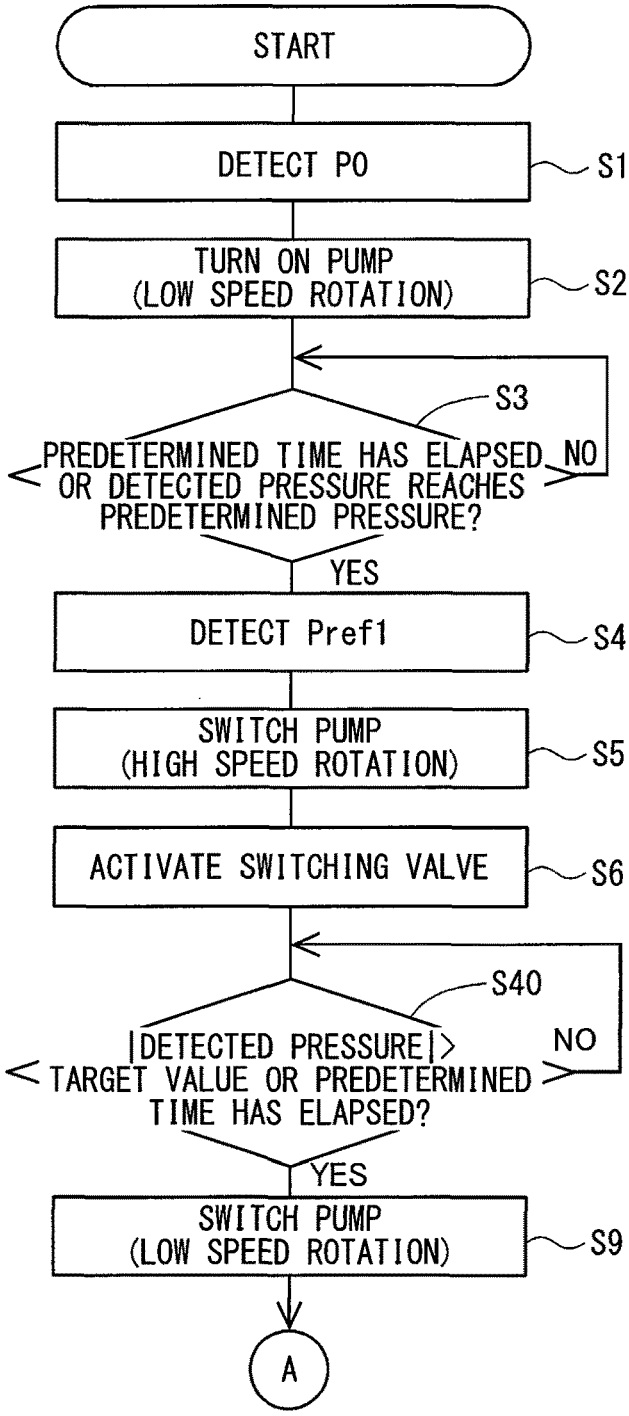
FIG. 14 is a flowchart of an inspection method in the inspection apparatus according to the fourth embodiment of the present disclosure.
Figure 15:
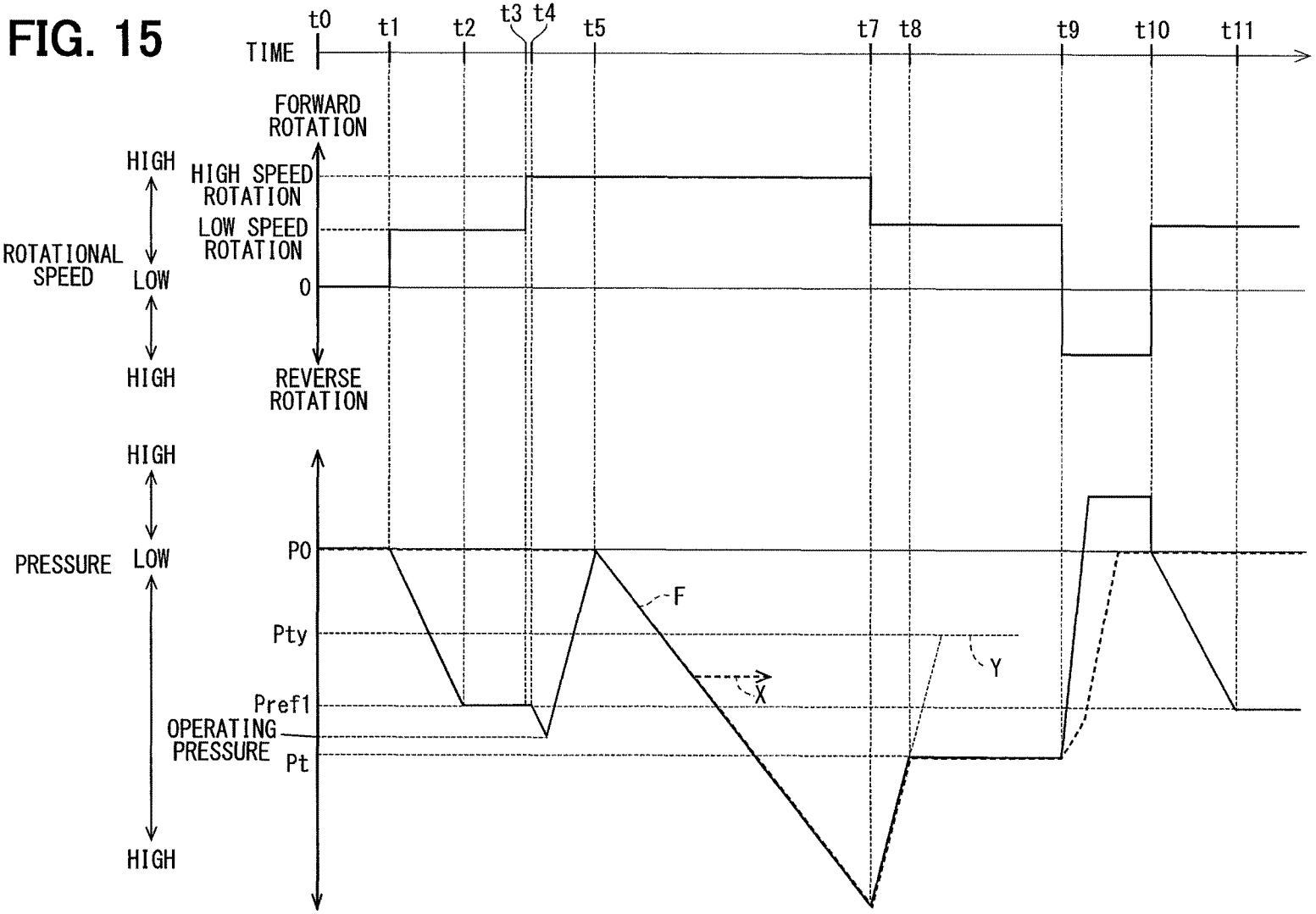
FIG. 15 is a time chart of an inspection of an evaporated fuel leakage in the inspection apparatus according to the fourth embodiment of the present disclosure.

Specifically, as shown in FIG. 14, the check valve 60 is provided between a portion P261 of the pressure passage 26 and a portion P262 and between the pump 20 and the ventilation orifice 23. The check valve 60 includes a housing 61, a valve member 62, and a spring 63.

The housing 61 has two ports 611 and 612. The port 611 communicates with the pressure passage 26 in which the ventilation orifice 23 is provided. The port 612 communicates with the pressure passage 26 to communicate with the portion P262. The two ports 611 and 612 communicate with a valve chamber 610 of the housing 61.

The valve member 62 is accommodated in the valve chamber 610 and provided so as to reciprocate. The valve member 62 is capable of abutting against a valve seat 613 formed to project around the inside of the port 612.

The spring 63 is provided in a radially inward direction of the valve seat 613. A first end of the spring 63 abuts against an inner wall of the housing 61. A second end of the spring 63 abuts against the valve member 62. The spring 63 urges the valve member 62 so that the valve member 62 is separated from the valve seat 613.

Figure 6:
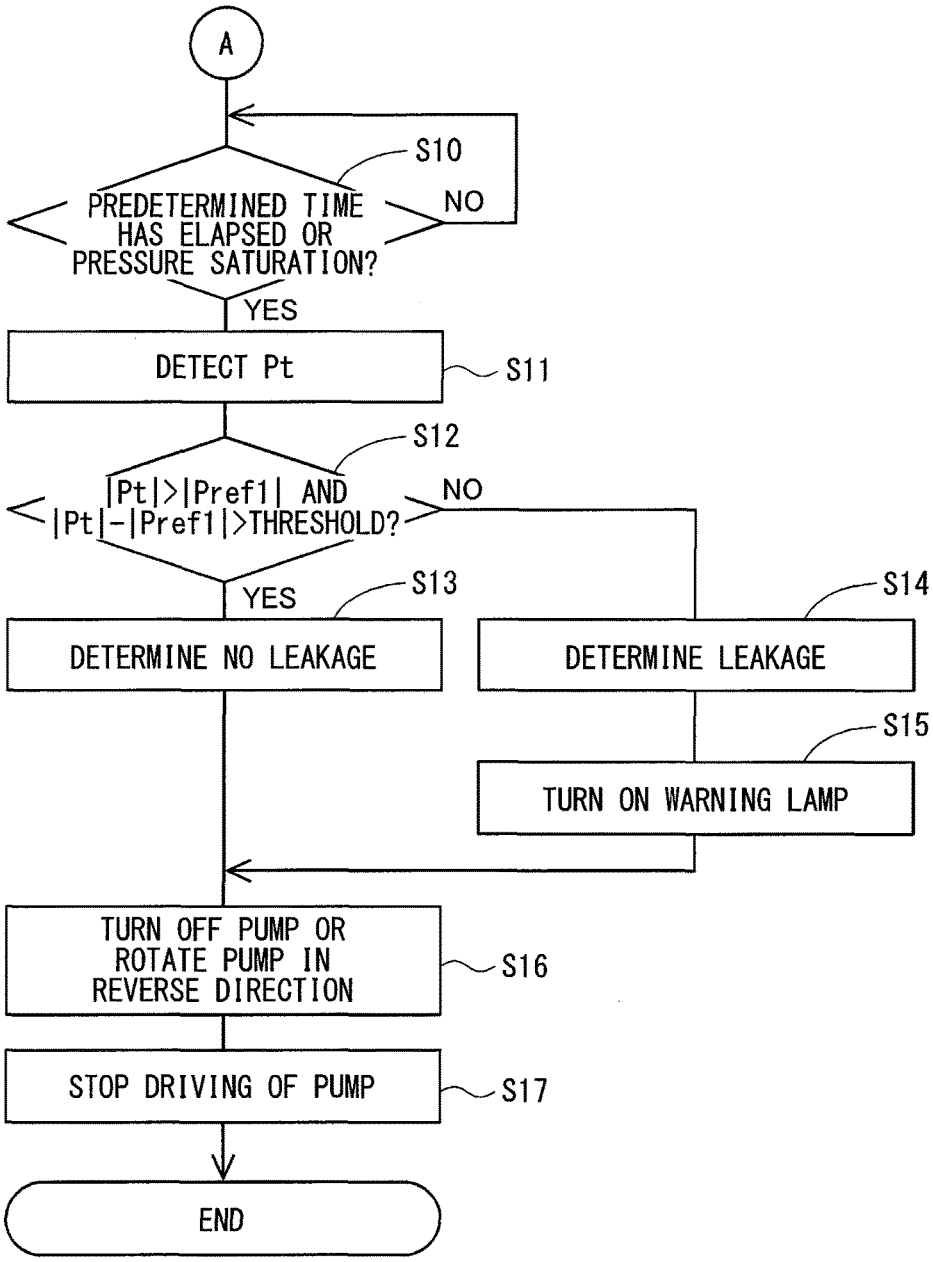
FIG. 6 is a flowchart of an inspection method of the evaporated fuel leakage in the inspection apparatus according to the first embodiment of the present disclosure.

The inspection method of the evaporated fuel leakage according to the fifth embodiment is performed along flowcharts of FIGS. 14 and 6.

In the check valve 60, when there is no relatively large pressure difference between the pressure of the gas at the port 611 and the pressure of the gas at the port 612, for example, when the pump 20 is driven at a low speed rotation in S9, the valve member 62 is spaced apart from the valve seat 613. Therefore, a flow of gas between the port 611 and the port 612 is allowed. On the other hand, when the pressure of the gas at the port 611 becomes larger than the pressure of the gas at the port 612 by a predetermined value or more, for example, when the driving of the pump 20 is stopped in S16, the valve member 62 abuts against the valve seat 613, to thereby shut off the flow of gas between the port 611 and the port 612. In other words, the check valve 60 is a normally open type check valve.

In the inspection apparatus 1 according to the fifth embodiment, when the driving of the pump 20 is stopped to return the pressure in the pressure chamber 32, the fuel tank 8, and so on to the atmospheric pressure in S16, the gas flows from the pressure chamber 32 into the fuel tank 8, the canister 10 or the like according to a size of a capacity. For that reason, a time until the pressure of the pressure chamber 32 is increased and the valve body 43 returns to the first position is prolonged.

Therefore, in the inspection apparatus 1 according to the fifth embodiment, a backflow from the pressure chamber 32 to the fuel tank 8 and the canister 10 is prevented by the check valve 60, and the time until the valve body 43 returns to the first position is shortened. As a result, the time required for inspecting the evaporated fuel leakage can be shortened.

Sixth Embodiment

Figure 17:
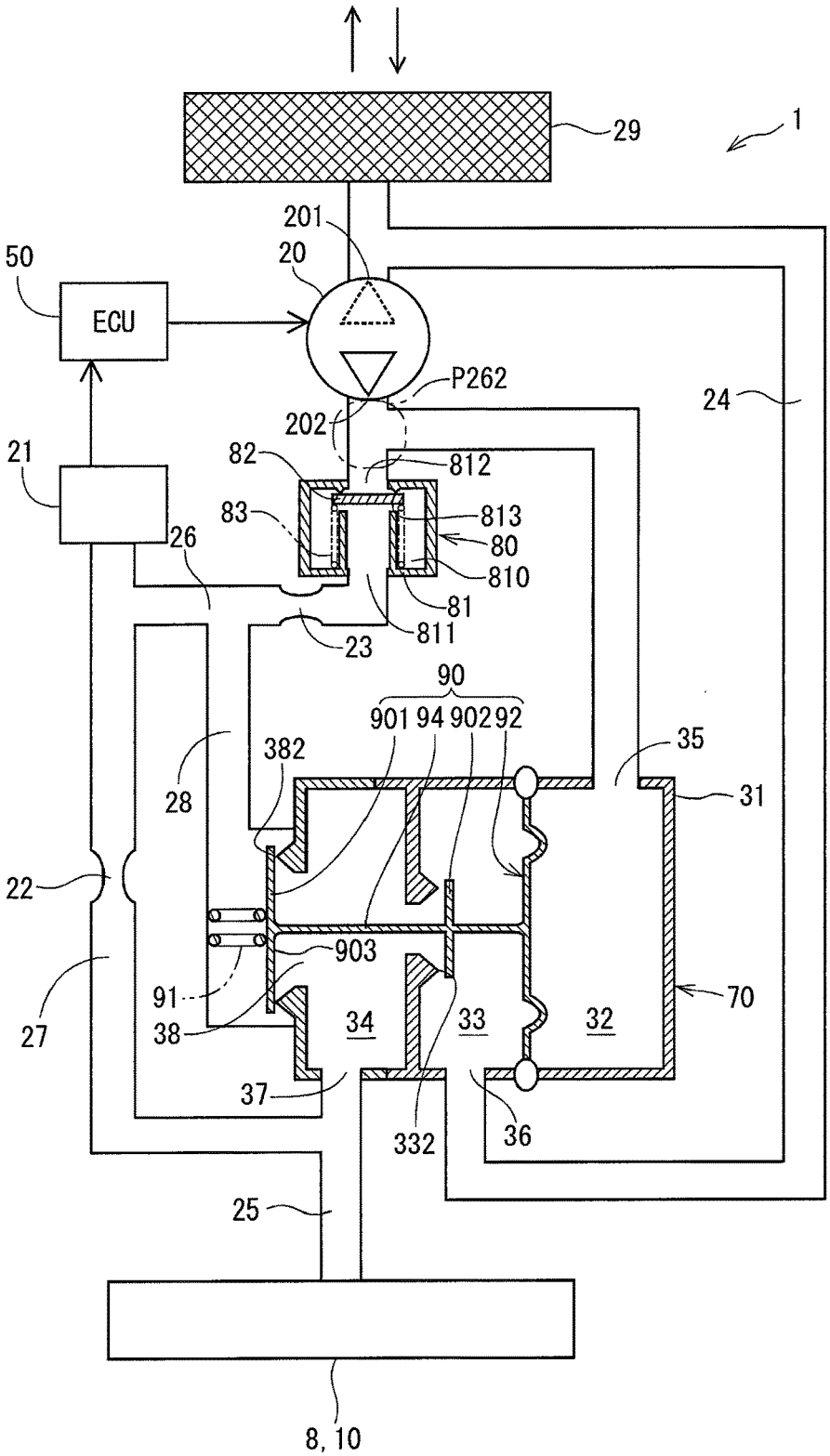
FIG. 17 is a schematic diagram of the inspection apparatus according to a sixth embodiment of the present disclosure.
Figure 18:
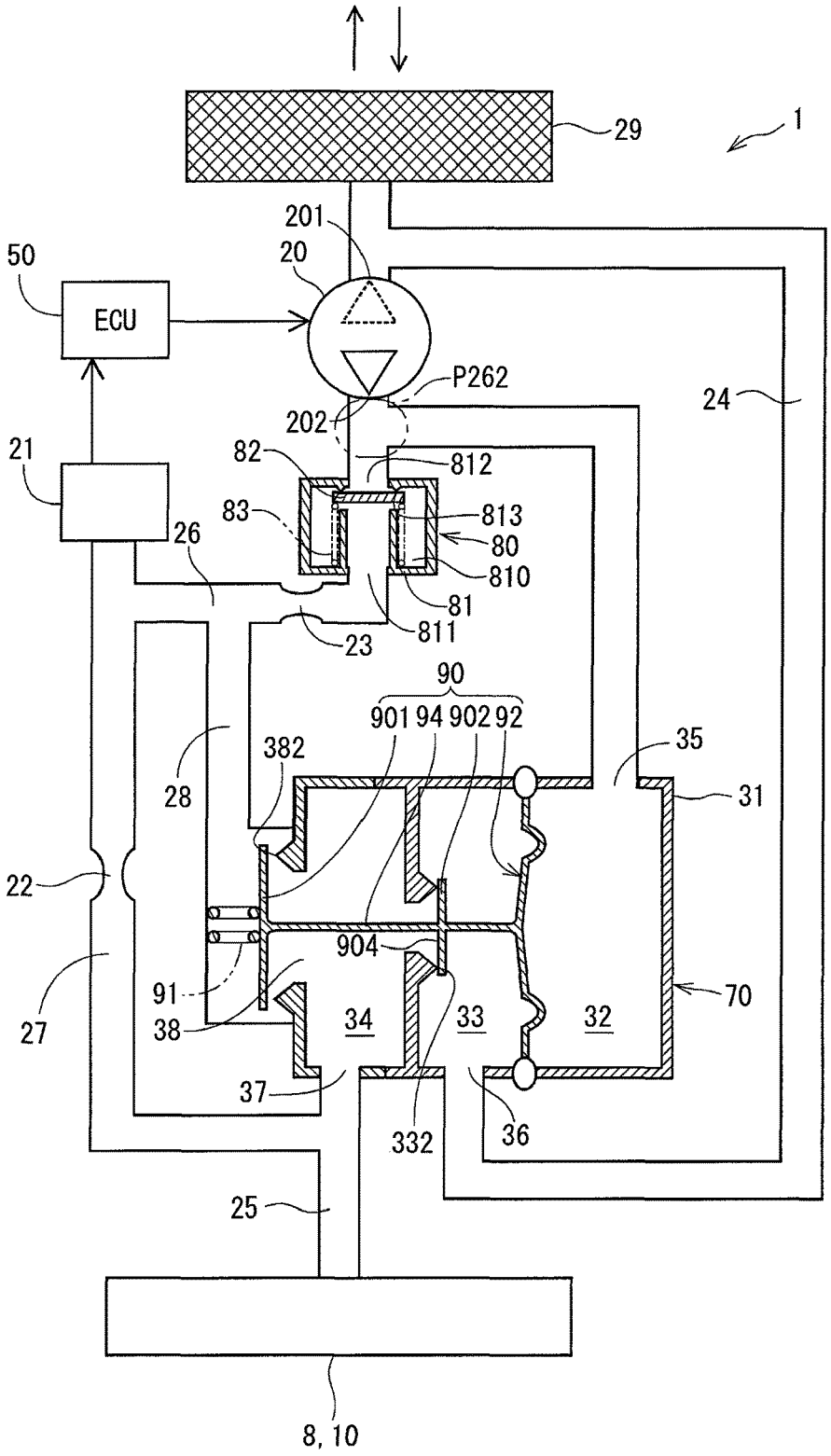
FIG. 18 is a schematic diagram showing a state in which a switching valve is operated in FIG. 17.

FIGS. 17 and 18 show the inspection apparatus 1 according to a sixth embodiment of the present disclosure. In the sixth embodiment, a switching valve 70 different in configuration from the switching valve 30 is provided, and a check valve 80 is disposed on the pressure passage 26 between the ventilation orifice 23 and the pump 20. In the inspection apparatus 1 according to the sixth embodiment, the pump 20 increases a pressure in the fuel tank 8 and the canister 10, thereby inspecting an evaporated fuel leakage from the fuel tank 8 and the canister 10.

The switching valve 70 is a differential pressure valve that operates according to a differential pressure between the pressure passage 26 and the atmospheric passage 24, which is changed by driving of the pump 20. The switching valve 70 has the housing 31, a valve member 90, and a spring 91.

The valve member 90 has a diaphragm 92, a first valve body 901, and a second valve body 902.

The diaphragm 92 separates the pressure chamber 32 from the atmospheric pressure chamber 33 and operates upon receiving a differential pressure between the pressure chamber 32 and the atmospheric pressure chamber 33.

The first valve body 901 and the second valve body 902 have a connecting portion 94 connected to the diaphragm 92 and operates together with the diaphragm 92.

The first valve body 901 is provided at an end of the connecting portion 94 protruding from the ventilation port 38 opposite to the diaphragm 92 connected to the other end of the connecting portion 94. As a result, the first valve body 901 reciprocates together with the connecting portion 94 outside the housing 31. The first valve body 901 can be seated and separated from a first valve seat 382 provided around the outside of the ventilation port 38. The first valve body 901 is urged to be seated on the first valve seat 382 by the spring 91 provided on a surface of the first valve body 901 opposite to the first valve seat 382 facing the other surface of the first valve body 901. The first valve body 901 may be seated on the first valve seat 382 by an elastic force of the diaphragm 92 per se without the provision of the spring 91.

The second valve body 902 is provided between the diaphragm 92 of the connecting portion 94 and the first valve body 901 so as to be reciprocable in the atmospheric pressure chamber 33. The second valve body 902 can be seated on and separated from a second valve seat 332 provided so as to protrude in a direction of the diaphragm 92 between the tank pressure chamber 34 and the atmospheric pressure chamber 33. When the second valve body 902 is seated on the second valve seat 332, the first valve body 901 is configured to be separated from the first valve seat 382.

As shown in FIG. 17, when the first valve body 901 is seated on the first valve seat 382, a communication of the second communication passage 28 with other than the pressure passage 26 is shut off, while the atmospheric passage 24 and the tank passage 25 communicate with each other. A position when the first valve body 901 is seated on the first valve seat 382 is referred to as a first position.

On the other hand, when the second valve body 902 is seated on the second valve seat 332, as shown in FIG. 18, a communication of the atmospheric passage 24 with other than the pump 20 and the atmosphere is shut off while the second communication passage 28 and the tank passage 25 communicate with each other. A position when the second valve body 902 is seated on the second valve seat 332 is referred to as a second position. The valve member 90 is movable between the first position and the second position.

As shown in FIG. 17, a surface of the first valve body 901 exposed to the ventilation port 38 when the first valve body 901 is seated on the first valve seat 382 is referred to as a first pressure receiving surface 903. As shown in FIG. 18, a surface of the second valve body 902 exposed to the atmospheric pressure chamber 33 when the second valve body 902 is seated on the second valve seat 332 is referred to as a second pressure receiving surface 904.

In this example, since an opening area of the second valve seat 332 is smaller than an opening area of the first valve seat 382, the second pressure receiving surface 904 is smaller than the first pressure receiving surface 903. For that reason, a force exerted on the second valve body 902 by the differential pressure between the tank pressure chamber 34 and the atmospheric pressure chamber 33 when the valve member 90 is at the second position is smaller than a force exerted on the first valve body 901 by the differential pressure between the second communication passage 28 and the tank pressure chamber 34 when the valve member 90 is at the first position. Therefore, the differential pressure between the atmospheric passage 24 and the pressure passage 26 when the valve member 90 is moved from the second position to the first position is smaller than the differential pressure between the atmospheric passage 24 and the pressure passage 26 when the valve member 90 is moved from the first position to the second position.

The differential pressure between the atmospheric passage 24 and the pressure passage 26 when the valve member 90 moves from the first position to the second position is referred to as operating pressure. The differential pressure between the atmospheric passage 24 and the pressure passage 26 when the valve member 90 moves from the second position to the first position is referred to as a return pressure. A relationship between the operating pressure and the return pressure in the switching valve 70 is the same as that of the switching valve 30.

The check valve 80 includes a housing 81, a valve member 82, and a spring 83.

The housing 81 has two ports 811 and 812. The port 811 communicates with the pressure passage 26 in which the ventilation orifice 23 is provided. The port 812 communicates with a portion P262 of the pressure passage 26 which is connected to the discharge port 202. The two ports 811 and 812 communicate with a valve chamber 810 of the housing 81.

The valve member 82 is accommodated in the valve chamber 810 and provided so as to reciprocate. The valve member 82 is capable of abutting against a valve seat 813 formed around the inside of the port 812.

The spring 83 is provided on a surface of the valve member 82 facing the valve seat 813. A first end of the spring 83 abuts against an inner wall of the housing 81. A second end of the spring 83 abuts against the valve member 82. The spring 83 urges the valve member 82 so that the valve member 82 abuts against the valve seat 813.

In the check valve 80, when the pressure of the gas at port 812 is smaller than the pressure of the gas at port 811 by a predetermined value, since the valve member 82 abuts against the valve seat 813, a flow of the gas is regulated between the port 811 and the port 812. On the other hand, when the pressure of the gas at the port 812 is larger than the pressure of the gas at the port 811 by the predetermined value or more, for example, when the pump 20 is driven at low speed rotation, the valve member 82 is separated from the valve seat 813, and the flow of gas between the port 811 and the port 812 is permitted. In other words, the check valve 80 is a normally closed type check valve.

Figure 19:
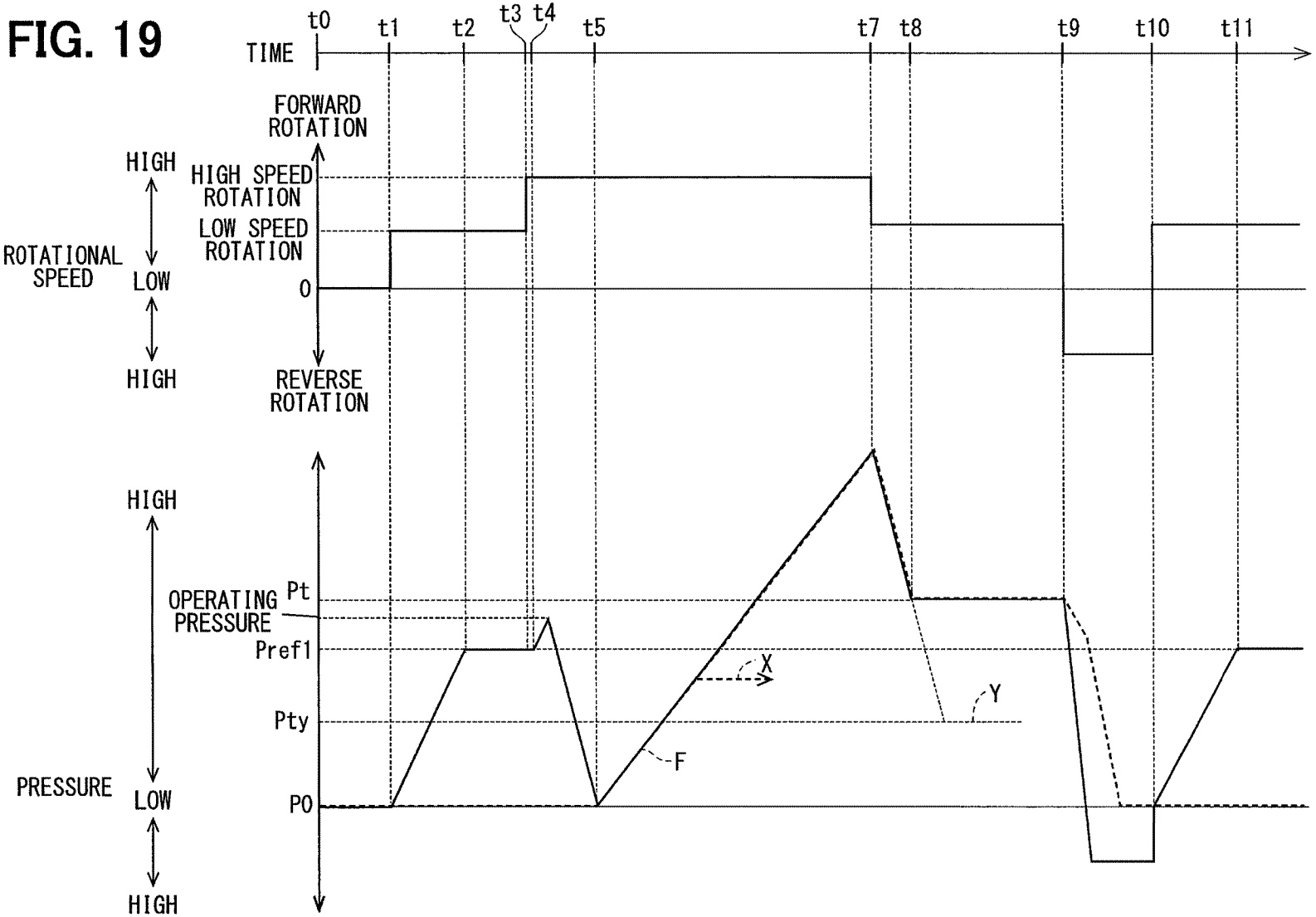
FIG. 19 is a time chart of an inspection of an evaporated fuel leakage in the inspection apparatus according to the sixth embodiment of the present disclosure.

Next, an inspection method of the evaporated fuel leakage according to the sixth embodiment will be described with reference to a time chart of FIG. 19. The inspection method of the evaporated fuel leakage according to the sixth embodiment is performed along flowcharts of FIGS. 14 and 6. FIG. 19 shows a graph in which an upper stage shows a time axis in the inspection of the evaporated fuel leakage, a middle stage shows the rotational speed of the pump 20 with time, and a lower stage shows a change in a detected pressure of the pressure sensor 21 with time. It is assumed that the pump 20 increases the pressure in the pressure passage 26 during a forward rotation. In this case, when referring to the magnitude of the pressure, the magnitude is assumed to be an absolute value.

The inspection of the evaporated fuel leakage is started a predetermined time after the operation of the engine 2 has been stopped. The predetermined time is set to a time required for the temperature of the vehicle to stabilize.

In S1, the ECU 50 detects an atmospheric pressure P0. The process is performed in a state where the pump 20 is stopped at a time t0 to a time t1 in FIG. 19. In this situation, the switching valve 70 is placed at the first position.

In S2, the ECU 50 drives the pump 20 at a low speed rotation. After the pump 20 has started to be driven at the low speed rotation at the time t1 in FIG. 19, the pressure detected by the pressure sensor 21 starts to increase. The air flows through the reference orifice 22 of the first communication passage 27 that communicates with the pressure passage 26 by driving the pump 20.

In S3, the ECU 50 determines whether a predetermined time has elapsed from a start of driving of the pump 20, or not. In that process, the detected pressure of the pressure sensor 21 which has increased after the time t1 in FIG. 19 reaches a first reference pressure Pref1 at a time t2. After the time t2, the first reference pressure Pref1 is maintained. In S3, instead of or in addition to determining the elapse of the predetermined time, the ECU 50 may perform a process of determining whether the detected pressure of the pressure sensor 21 reaches a predetermined pressure and is maintained at the predetermined pressure, or not.

In S4, the ECU 50 stores the detected pressure of the pressure sensor 21 as the first reference pressure Pref1 (between the time t2 and a time t3 in FIG. 19).

In S5, the ECU 50 switches the driving of the pump 20 to the high speed rotation. When the driving of the pump 20 is switched to a high speed rotation at the time t3 in FIG. 19, the detected pressure of the pressure sensor 21 gradually increases after a time t4 in FIG. 19. When the detected pressure of the pressure sensor 21 reaches an operating pressure, the valve member 90 starts to move from the first position to the second position (S6). In the sixth embodiment, when the valve member 90 moves, the detected pressure of the pressure sensor 21 temporarily returns to the atmospheric pressure at a time t5 in FIG. 19, and thereafter changes like a pressure waveform (broken line F) in the canister 10 and the fuel tank 8.

When the valve member 90 is moving from the first position to the second position in S6, the inside of the canister 10 and the inside of the fuel tank 8 are increased in pressure. As a result, when the fuel tank 8 or the canister 10 has a hole smaller than a total of a cross-sectional area of the reference orifice 22 and a cross-sectional area of the ventilation orifice 23, or when no hole is provided in the fuel tank 8 or the canister 10, the detected pressure of the pressure sensor 21 becomes larger than a system pressure Pt.

On the other hand, when the fuel tank 8 or the canister 10 has a hole larger than the total of the cross-sectional area of the reference orifice 22 and the cross-sectional area of the ventilation orifice 23, the detected pressure is maintained at a pressure corresponding to the size of the hole from which the fuel vapor may be leaked as indicated by a broken line X in the graph of the detected pressure of the pressure sensor 21 in FIG. 19.

In S40, the ECU 50 determines whether a predetermined time has elapsed after the detected pressure of the pressure sensor 21 has reached a target value, or not. The ECU 50 repeats the processing of S40 until the predetermined time has elapsed. The ECU 50 shifts the processing to S9 the predetermined time after the detected pressure of the pressure sensor 21 has reached the target value.

In addition, the ECU 50 may determine whether a predetermined time has elapsed after the pump 20 has been switched to the high speed rotation, or not.

In S9, the ECU 50 switches the driving of the pump 20 to the low speed rotation. In this process, the pump 20 is switched to the low speed rotation at a time t7 in FIG. 19, and thereafter the detected pressure decreases. However, the switching valve 70 is kept in a state of the second position without switching.

In S10, the ECU 50 determines whether a predetermined time has elapsed after the driving of the pump 20 has been switched to the low speed rotation, or not. The ECU 50 repeats the processing of S10 until the predetermined time has elapsed. In this process, after a time t8 in FIG. 19, the detected pressure of the pressure sensor 21 is maintained at the constant pressure.

In S10, the ECU 50 may perform a process of determining whether the detected pressure of the pressure sensor 21 has been maintained at a predetermined pressure, or not, instead of or in addition to the process of determining the elapse of the predetermined time.

In S11, the ECU 50 stores the detected pressure of the pressure sensor 21 as the system pressure Pt. The process is performed between the time t8 and a time t9 in FIG. 19.

In S12, the ECU 50 compares the first reference pressure Pref1 with the system pressure Pt. When the absolute value of the system pressure Pt is larger than the absolute value of the first reference pressure Pref1 and an absolute value of a difference between the system pressure Pt and the first reference pressure Pref1 is larger than a predetermined threshold, the ECU 50 shifts the processing to S13.

In S13, the ECU 50 determines that the hole of the evaporated fuel leakage from the fuel tank 8 or the canister 10 is smaller than the reference value.

On the other hand, when the absolute value of the system pressure Pt is equal to or smaller than the absolute value of the first reference pressure Pref1 or when the absolute value of the difference between the system pressure Pt and the first reference pressure Pref1 is equal to or smaller than the predetermined threshold in S12, the ECU 50 shifts the processing to S14. This is a case where the detected pressure of the pressure sensor 21 is indicated by a broken line Y (system pressure Pty shown in FIG. 19) in the graph on a lower stage of FIG. 19.

In S14, the ECU 50 determines that the evaporated fuel leakage from the fuel tank 8 or the canister 10 is larger than a reference value.

In S15, the ECU 50 performs a process of turning on a warning lamp of an instrument panel during next engine operation.

In S16, the ECU 50 stops driving the pump 20 or rotates the impeller of the pump 20 in a reverse direction. In both of those cases, the detected pressure decreases after the time t9 in FIG. 19. When the differential pressure between the pressure passage 26 and the atmospheric passage 24 becomes smaller than the return pressure of the switching valve 70, the switching valve 70 starts the switching operation from the second position to the first position.

When the switching valve 70 has been switched to the first position, the ECU 50 stops driving the pump 20 in S17. At this time, the check valve 80, which is a normally closed type check valve, shuts off the flow of gas between the port 811 and the port 812. As a result, after the pressure of the pressure chamber 32 having a capacity smaller than that of the fuel tank 8 and the canister 10 becomes close to the atmospheric pressure to some extent, the pressure in the fuel tank 8 and the canister 10 returns to the atmospheric pressure.

In this way, the inspection method of the evaporated fuel leakage according to the sixth embodiment is completed.

The inspection apparatus 1 according to the sixth embodiment increases the pressure in the fuel tank 8 and the canister 10 to inspect the evaporated fuel leakage. In this case, when the driving of the pump 20 is stopped to return the pressure in the pressure chamber 32, the fuel tank 8, and so on to the atmospheric pressure in S16, the gas flows from the pressure chamber 32 into the fuel tank 8, the canister 10 or the like according to a size of a capacity. For that reason, a time until the pressure of the pressure chamber 32 is increased and the valve body 43 returns to the first position is prolonged. At this time, a back flow from the pressure chamber 32 to the fuel tank 8 and the canister 10 is prevented by the check valve 80. As a result, the time required for the valve member 90 to return to the first position can be shortened.

In the inspection apparatus 1 according to the sixth embodiment, the valve member 90 includes the first valve body 901 which can be seated on the first valve seat 382 and the second valve body 902 which can be seated on the second valve seat 332. Since the first valve body 901 and the second valve body 902 are placed apart from each other by a predetermined distance, the time required for the valve member 90 to move for switching the first position and the second position in the switching valve 70 can be shortened.

Other Embodiments

In the embodiments described above, the inspection apparatus 1 reduces the pressure in the pressure passage 26 by driving the pump 20, to thereby operate the switching valve 30, and detect the first reference pressure Pref1, the second reference pressure Pref2, and the system pressure Pt. On the other hand, in another embodiment, the inspection apparatus 1 may increase the pressure in the pressure passage 26 by driving the pump 20, to thereby operate the switching valve 30, so as to detect a first reference pressure Pref1, a second reference pressure Pref2, and a system pressure Pt. In this case, the driving of the pump 20 shown in the middle stage of FIG. 7 is a graph in which the forward rotation and the reverse rotation are reversed with respect to the rotational speed zero. The change in the detected pressure of the pressure sensor 21 shown in the lower stage of FIG. 7 is a graph in which the pressure reduction region and the pressurization region are reversed with respect to the atmospheric pressure P0.

As described above, the present disclosure is not limited to the embodiments described above, and can be applied to various embodiments without departing from the spirit of the present disclosure.

In the fourth to sixth embodiments, the ventilation orifice 23 is provided between the portion P261 of the pressure passage 26 which is connected to the second communication passage 28 and the portion P262 of the pressure passage 26 which is connected to the intake port 201 or the discharge port 202. However, the ventilation orifice 23 may be provided between a portion P264 (refer to FIG. 13) of the pressure passage 26 which is connected to the pressure introduction port 35 and a portion P262, or between the portion P262 and a portion P261 of the pressure passage 26. Further, the ventilation orifice 23 may be used in combination with the ventilation orifice 23 provided in the second communication passage 28 of the first and second embodiments.

In the sixth embodiment, the inspection apparatus 1 is provided with the check valve 80. The check valve 80 may be omitted. Also, the ventilation orifice 23 may be eliminated.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. An inspection apparatus detecting an evaporated fuel leakage in a fuel tank, comprising:

a pressure sensor;

a reference orifice disposed in a first communication passage that communicates a pressure passage provided with the pressure sensor, with a tank passage communicating with the fuel tank;

a pump configured to depressurize or pressurize the pressure passage, the pump including an intake port and a discharge port, one of the intake port and the discharge port communicates with an atmospheric passage that communicates with the atmosphere and the other one of the intake port and the discharge port communicates with the pressure passage; and a switching valve configured to operate according to a differential pressure between the pressure passage and the atmospheric passage, which changes depending on the driving of the pump, and to switch between a state to shut off a communication of a second communication passage that leads to the pressure passage and passages other than the pressure passage and to communicate the atmospheric passage with the tank passage and a state to shut off a communication of the atmospheric passage and passages other than the pump and the atmosphere and to communicate the second communication passage with the tank passage.

2. The inspection apparatus according to claim 1, wherein the switching valve includes a housing including a pressure chamber, an atmospheric pressure chamber, and a tank pressure chamber, a pressure introduction port that communicates the pressure passage with the pressure chamber, an atmosphere port that communicates the atmospheric passage with the atmospheric pressure chamber, a tank port that communicates the tank passage with the tank pressure chamber, a ventilation port that communicates the second communication passage with the tank pressure chamber, and a valve member that moves according to a differential pressure between the pressure chamber and the atmospheric pressure chamber.

3. The inspection apparatus according to claim 2, wherein the valve member is movable between a first position to shut off the communication of the second communication passage and the passages other than the pressure passage and to communicate the atmospheric passage with the tank passage and a second position to shut off the communication of the atmospheric passage and the passages other than the pump and the atmosphere and to communicate the second communication passage with the tank passage, and an absolute value of the differential pressure between the pressure chamber and the atmospheric pressure chamber when the valve member moves from the second position to the first position is smaller than an absolute value of the differential pressure between the pressure chamber and the atmospheric pressure chamber when the valve member moves from the first position to the second position.

4. The inspection apparatus according to claim 3, wherein the valve member includes a diaphragm that separates the pressure chamber from the atmospheric pressure chamber and moves upon receiving the differential pressure between the pressure chamber and the atmospheric pressure chamber, and a valve body that includes a first seat surface which is seated on and separated from a first valve seat disposed in the ventilation port, and a second seat surface which is seated on and separated from a second valve seat disposed between the tank pressure chamber and the atmospheric pressure chamber, and the valve body moves together with the diaphragm, and the valve body includes a first pressure receiving surface and a second pressure receiving surface that is smaller than the first pressure receiving surface, wherein the first pressure receiving surface is exposed to the ventilation port when the valve body is seated on the first valve seat, and the second pressure receiving surface is exposed to the atmospheric pressure chamber when the valve body is seated on the second valve seat.

5. The inspection apparatus according to claim 3, wherein when an atmospheric pressure that passes through only the first communication passage provided with the reference orifice when the pump is rotated at a low speed is set as a first reference pressure, and an atmospheric pressure that passes through the first communication passage and the second communication passage when the pump is rotated at a high speed is set as a second reference pressure, an absolute value of a differential pressure between the pressure passage and the atmospheric passage when the valve member moves from the first position to the second position is set to be larger than an absolute value of a leakage determination threshold set based on the absolute value of the first reference pressure or larger than an absolute value of the first reference pressure and is set to be smaller than an absolute value of the second reference pressure, and the absolute value of the differential pressure between the pressure passage and the atmospheric passage when the valve member moves from the second position to the first position is set to be smaller than the absolute value of the first reference pressure or smaller than the absolute value of the leakage determination threshold and is set to be larger than zero.

6. The inspection apparatus according to claim 2, wherein the pressure passage communicates with the intake port or the discharge port of the pump, the second communication passage that communicates the switching valve with the pressure passage, and the first communication passage in order from an end communicating with the pressure introduction port, and the pressure passage further includes a ventilation orifice that is disposed between a portion of the pressure passage which is connected to the second communication passage and a portion of the pressure passage which is connected to the pressure introduction port.

7. The inspection apparatus according to claim 2, wherein the pressure passage communicates with the intake port or the discharge port of the pump, the second communication passage that communicates the switching valve with the pressure passage, and the first communication passage in order from an end communicating with the pressure introduction port, and the pressure passage further includes a check valve that is disposed between the portion of the pressure passage which is connected to the second communication passage and a portion of the pressure passage which is connected to the intake port or the discharge port of the pump.

8. The inspection apparatus according to claim 7, wherein the check valve is of a normally open type, and is closed when a pressure of the pressure passage at a port of the check valve which is connected to the second communication passage is larger than a pressure of the pressure passage at a port of the check valve which is connected to the intake port or the discharge port of the pump by a predetermined value or more when the pump reduces a pressure in the pressure passage.

9. The inspection apparatus according to claim 7, wherein the check valve is of a normally closed type, and is open when a pressure of the pressure passage at a port of the check valve which is connected to the intake port or the discharge port of the pump is larger than a pressure of the pressure passage at a port of the check valve which is connected to the second communication passage by a predetermined value or more when the pump increases a pressure in the pressure passage.

10. The inspection apparatus according to claim 2, further comprising:

a ventilation orifice that is disposed in the second communication passage communicating the switching valve with the pressure passage.

11. An inspection method for inspecting an evaporated fuel leakage for use in an inspection apparatus detecting an evaporated fuel leakage in a fuel tank including a pressure sensor, a reference orifice disposed in a first communication passage that communicates a pressure passage provided with the pressure sensor, with a tank passage communicating with the fuel tank, a pump configured to depressurize or pressurize the pressure passage, the pump including an intake port and a discharge port, one of the intake port and the discharge port communicates with an atmospheric passage that communicates with the atmosphere and the other one of the intake port and the discharge port communicates with the pressure passage, and a switching valve configured to operate according to a differential pressure between the pressure passage and the atmospheric passage, which changes depending on the driving of the pump, and to switch between a state to shut off a communication of a second communication passage that leads to the pressure passage and passages other than the pressure passage and to communicate the atmospheric passage with the tank passage and a state to shut off a communication of the atmospheric passage and passages other than the pump and the atmosphere and to communicate the second communication passage with the tank passage, the method comprising:

storing a pressure detected by the pressure sensor when the pump is rotated at a low speed in a case where the switching valve shuts off the communication of the second communication passage and the passages other than the pressure passage and allows the communication of the atmospheric passage and the tank passage, as a first reference pressure;

reducing a pressure in the tank passage in a state where the switching valve shuts off the communication of the atmospheric passage and the passages other than the pump and the atmosphere and allows the communication of the second communication passage and the tank passage by switching the pump from a low speed rotation to a high speed rotation;

storing a pressure detected by the pressure sensor in the state in the reducing by rotating the pump at the low speed, as a system pressure; and determining that the evaporated fuel leakage of the fuel tank is larger than a reference value when an absolute value of the system pressure is smaller than the absolute value of the first reference pressure or when an absolute value of a difference between the system pressure and the first reference pressure is smaller than a predetermined threshold while comparing the first reference pressure with the system pressure, and determining that the evaporated fuel leakage of the fuel tank is smaller than the reference value when the absolute value of the system pressure is larger than the absolute value of the first reference value and the absolute value of the difference between the system pressure and the first reference pressure is larger than the predetermined threshold while comparing the first reference pressure with the system pressure.

12. The inspection method according to claim 11, further comprising:

determining that the evaporated fuel leakage of the fuel tank is larger than a large diameter reference value when a state where an absolute value of the pressure detected by the pressure sensor is equal to or smaller than the absolute value of a second reference pressure continues for a predetermined period in the reducing, wherein the large diameter reference value is larger than a small diameter reference value that is the reference value, and the second reference pressure is an atmospheric pressure that passes through the first communication passage and the second communication passage when the pump is rotated at the high speed.

* * * * *